US012588713B2

(12) United States Patent
Fujita et al.

(10) Patent No.: US 12,588,713 B2
(45) Date of Patent: Mar. 31, 2026

(54) INHALATION DEVICE, CONTROL METHOD, AND NON-TRANSITORY COMPUTER READABLE MEDIUM

(71) Applicant: JAPAN TOBACCO INC., Tokyo (JP)

(72) Inventors: Ryoji Fujita, Tokyo (JP); Tateki Sumii, Tokyo (JP); Manabu Yamada, Tokyo (JP); Yasunobu Inoue, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 438 days.

(21) Appl. No.: 18/073,957

(22) Filed: Dec. 2, 2022

(65) Prior Publication Data

US 2023/0102855 A1 Mar. 30, 2023

Related U.S. Application Data

(63) Continuation of application No. PCT/JP2020/038422, filed on Oct. 12, 2020.

(51) Int. Cl.
*A24F 40/57* (2020.01)
*A24F 40/46* (2020.01)

(52) U.S. Cl.
CPC ..... *A24F 40/57* (2020.01); *A24F 40/46* (2020.01)

(58) Field of Classification Search
None
See application file for complete search history.

(56) References Cited

U.S. PATENT DOCUMENTS 5,665,262 A * 9/1997 Hajaligol ..... A24F 40/46 131/194
2019/0380389 A1 12/2019 Hong et al.
2020/0046033 A1 2/2020 Robert et al.
(Continued)

FOREIGN PATENT DOCUMENTS

CN 108618207 A 10/2018
CN 109043665 A 12/2018
(Continued)

OTHER PUBLICATIONS

CN_108618207 English Translation (Year: 2018).*
(Continued)

*Primary Examiner* — Manley L Cummins, IV
(74) *Attorney, Agent, or Firm* — Birch, Stewart, Kolasch & Birch, LLP

(57) ABSTRACT

An inhalation device includes a heating part for heating a base material to generate aerosol and a control part for controlling operation of the heating part on the basis of a heating profile in which a target temperature is specified, the target temperature being a target value for the temperature of the heating part, wherein: the heating profile includes time sections continuous along a time axis; in each of the plurality of time sections, the target temperature at the end of each time section is set; the heating profile includes a midway temperature drop section on the way; the target temperature set in the midway temperature drop section is lower than the target temperature set in the time section immediately preceding the midway temperature drop section; and the control part performs control such that the heating part is not supplied with power in the midway temperature drop section.

17 Claims, 17 Drawing Sheets

(56) References Cited

U.S. PATENT DOCUMENTS

| | | | | |
|---|---|---|---|---|
| 2020/0275707 | A1 | 9/2020 | Courbat | |
| 2021/0000184 | A1* | 1/2021 | Moloney | A24F 40/57 |
| 2021/0007408 | A1* | 1/2021 | Nakano | A61M 15/06 |
| 2021/0345673 | A1* | 11/2021 | Reevell | A24F 40/20 |
| 2024/0251876 | A1 | 8/2024 | Kuczaj | |

FOREIGN PATENT DOCUMENTS

| | | | |
|---|---|---|---|
| EP | 3 871 530 | A1 | 9/2021 |
| JP | 8-511176 | A | 11/1996 |
| JP | 2017-113016 | A | 6/2017 |
| WO | WO 95/27412 | A1 | 10/1995 |
| WO | WO 2019/171017 | A1 | 9/2019 |
| WO | WO 2019/186666 | A1 | 10/2019 |
| WO | 2020/084756 | A1 | 4/2020 |
| WO | WO 2020/074600 | A1 | 4/2020 |
| WO | WO 2020/084773 | A1 | 4/2020 |

OTHER PUBLICATIONS

CN_109043665 with English translation (Year: 2018).*
WO_2020084756 with English translation (Year: 2020).*
Japanese Office Action for Japanese Application No. 2022-557224, dated Feb. 25, 2025, with English translation.
Extended European Search Report for European Application No. 20957580.2, dated Jun. 6, 2024.
International Search Report (PCT/ISA/210), issued in PCT/JP2020/038422, dated Nov. 24, 2020.
English translation of the Korean Office Action for Korean Application No. 10-2022-7033804, dated Sep. 1, 2025.
English translation of Chinese Office Action for Chinese Application No. 202080100379.7, dated January 16, 2026.

* cited by examiner

INHALATION DEVICE, CONTROL METHOD, AND NON-TRANSITORY COMPUTER READABLE MEDIUM

CROSS REFERENCES TO RELATED APPLICATIONS

This application is a continuation application based on International Patent Application No. PCT/JP2020/038422 filed on Oct. 12, 2020, and the content of the PCT international application is incorporated herein by reference.

TECHNICAL FIELD

The present invention relates to an inhaler device, a control method, and a non-transitory computer readable medium.

BACKGROUND ART

Inhaler devices, such as e-cigarettes and nebulizers, for generating a substance to be inhaled by a user are widespread. For example, an inhaler device generates an aerosol to which a flavor component is imparted, by using a substrate including an aerosol source for generating the aerosol, a flavor source for imparting the flavor component to the generated aerosol, and the like. The user inhales the aerosol to which the flavor component is imparted, which is generated by the inhaler device, to taste the flavor.

The inhaler device heats the substrate in accordance with a heating profile that defines a heating action to generate an aerosol. The heating profile greatly affects the quality of experience with the inhaler device. Accordingly, various heating profiles have been studied. For example, Patent Literature 1 below discloses a heating profile in which a temperature first reaches the highest temperature after the start of heating and then gradually decreases.

CITATION LIST

Patent Literature

Patent Literature 1: WO2020/084773

SUMMARY OF INVENTION

Technical Problem

However, it is desirable to further improve the quality of experience with an inhaler device.

The present invention has been made in view of the above problem, and it is an object of the present invention to provide a mechanism capable of further improving the quality of experience with an inhaler device.

Solution to Problem

In order to solve the above problem, according to an aspect of the present invention, there is provided an inhaler device including a heater configured to heat a substrate to generate an aerosol, and a controller configured to control an operation of the heater in accordance with a heating profile that defines a time-series progression of a target temperature, the target temperature being a target value of a temperature of the heater. The heating profile includes a plurality of time sections that are continuous along a time axis. Each of the plurality of time sections is assigned the target temperature for an end of each time section. The heating profile includes an intermediate temperature drop section in an intermediate portion thereof. The target temperature set for the intermediate temperature drop section is lower than the target temperature set for a time section immediately before the intermediate temperature drop section. The controller is configured to perform control such that no electric power is supplied to the heater in the intermediate temperature drop section.

The controller may be configured to control the operation of the heater in accordance with an actual temperature of the heater and the target temperature set for the intermediate temperature drop section at a beginning of a time section subsequent to the intermediate temperature drop section.

The controller may be configured to supply electric power to the heater at a first duty ratio at the beginning of the time section subsequent to the intermediate temperature drop section in a case where the actual temperature of the heater is less than the target temperature set for the intermediate temperature drop section, and supply electric power to the heater at a second duty ratio at the beginning of the time section subsequent to the intermediate temperature drop section in a case where the actual temperature of the heater is equal to or higher than the target temperature set for the intermediate temperature drop section, and the first duty ratio may be larger than the second duty ratio.

The controller may be configured to determine an end of the intermediate temperature drop section in accordance with an elapsed time from a beginning of the intermediate temperature drop section.

The controller may be configured to determine an end of the intermediate temperature drop section in accordance with a difference between the target temperature set for the intermediate temperature drop section and an actual temperature of the heater.

The heating profile may include an initial temperature rise section at a beginning thereof, and the target temperature set for the initial temperature rise section may be higher than an initial value.

The initial temperature rise section may include a first temperature rise section and a second temperature rise section subsequent to the first temperature rise section. The first temperature rise section and the second temperature rise section may have different temperature rise widths per unit time. The temperature rise width per unit time in the first temperature rise section may have a value obtained by dividing a difference between the target temperature set for the first temperature rise section and the initial value by a time length of the first temperature rise section. The temperature rise width per unit time in the second temperature rise section may have a value obtained by dividing a difference between the target temperature set for the second temperature rise section and the target temperature set for the first temperature rise section by a time length of the second temperature rise section.

The temperature rise width per unit time in the second temperature rise section may be smaller than the temperature rise width per unit time in the first temperature rise section.

The initial temperature rise section may include a temperature maintenance section at an end thereof, and the target temperature set for the temperature maintenance section may be the same as the target temperature set for a time section immediately before the temperature maintenance section.

The heating profile may include a temperature re-rise section after the intermediate temperature drop section, and the target temperature set for the temperature re-rise section may be higher than the target temperature set for a time section immediately before the temperature re-rise section.

The temperature re-rise section alternately includes a temperature maintenance section and a temperature rise section, the target temperature set for the temperature maintenance section may be the same as the target temperature set for a time section immediately before the temperature maintenance section, and the target temperature set for the temperature rise section may be higher than the target temperature set for a time section immediately before the temperature rise section.

The heating profile may include the initial temperature rise section, the intermediate temperature drop section, and the temperature re-rise section in sequence.

The heating profile may include the initial temperature rise section, a temperature maintenance section, the intermediate temperature drop section, and the temperature re-rise section in sequence, and the target temperature set for the temperature maintenance section may be the same as the target temperature set for a time section immediately before the temperature maintenance section.

When compared among the initial temperature rise section, the intermediate temperature drop section, and the temperature re-rise section, an absolute value of an amount of change in the target temperature per unit time may be smallest in the temperature re-rise section, second smallest in the intermediate temperature drop section, and largest in the initial temperature rise section. The absolute value of the amount of change in the target temperature per unit time in the initial temperature rise section may be a value obtained by dividing an absolute value of a difference between the target temperature set for the initial temperature rise section and the initial value by a time length of the initial temperature rise section. The absolute value of the amount of change in the target temperature per unit time in the intermediate temperature drop section may be a value obtained by dividing an absolute value of a difference between the target temperature set for the intermediate temperature drop section and the target temperature set for the time section immediately before the intermediate temperature drop section by a time length of the intermediate temperature drop section. The absolute value of the amount of change in the target temperature per unit time in the temperature re-rise section may be a value obtained by dividing an absolute value of a difference between the target temperature set for the temperature re-rise section and the target temperature set for the time section immediately before the temperature re-rise section by a time length of the temperature re-rise section.

When a time length of the initial temperature rise section, a time length of the intermediate temperature drop section, and a time length of the temperature re-rise section are compared, the time length of the intermediate temperature drop section may be shortest, the time length of the initial temperature rise section is second shortest, and the time length of the temperature re-rise section is longest.

The inhaler device may further include a chamber configured to receive the substrate. The chamber may include an opening into which the substrate is to be inserted, and a holder configured to hold the substrate. The holder may include a pressing portion configured to press a portion of the substrate, and a non-pressing portion.

The heater may be disposed on an outer surface of the pressing portion.

The heating profile may include a plurality of slots, the plurality of slots being time sections that are continuous along a time axis. Each of the plurality of slots may be assigned a plurality of switching conditions. The controller may be configured to switch a slot for which any one of the plurality of switching conditions is satisfied among the plurality of slots to another slot among the plurality of slots and control the operation of the heater in accordance with the another slot.

The controller may be configured to control the operation of the heater in accordance with a deviation of an actual temperature of the heater from the target temperature corresponding to an elapsed time from a start of control of the operation of the heater based on the heating profile.

In order to solve the above problem, furthermore, according to another aspect of the present invention, there is provided a control method for controlling an inhaler device including a heater configured to heat a substrate to generate an aerosol. The control method includes controlling an operation of the heater in accordance with a heating profile that defines a time-series progression of a target temperature, the target temperature being a target value of a temperature of the heater. The heating profile includes a plurality of time sections that are continuous along a time axis. Each of the plurality of time sections is assigned the target temperature for an end of each time section. The heating profile includes an intermediate temperature drop section in an intermediate portion thereof. The target temperature set for the intermediate temperature drop section is lower than the target temperature set for a time section immediately before the intermediate temperature drop section. The controlling of an operation of the heater includes performing control such that no electric power is supplied to the heater in the intermediate temperature drop section.

In order to solve the above problem, furthermore, according to another aspect of the present invention, there is provided a non-transitory computer readable medium having a program stored therein, the program for causing a computer for controlling an inhaler device including a heater configured to heat a substrate to generate an aerosol, to execute controlling an operation of the heater in accordance with a heating profile that defines a time-series progression of a target temperature, the target temperature being a target value of a temperature of the heater. The heating profile includes a plurality of time sections that are continuous along a time axis. Each of the plurality of time sections is assigned the target temperature for an end of each time section. The heating profile includes an intermediate temperature drop section in an intermediate portion thereof. The target temperature set for the intermediate temperature drop section is lower than the target temperature set for a time section immediately before the intermediate temperature drop section. The controlling of an operation of the heater includes performing control such that no electric power is supplied to the heater in the intermediate temperature drop section.

Advantageous Effects of Invention

As described above, according to the present invention, there is provided a mechanism capable of further improving the quality of experience with an inhaler device.

DESCRIPTION OF EMBODIMENTS

Figure 1:
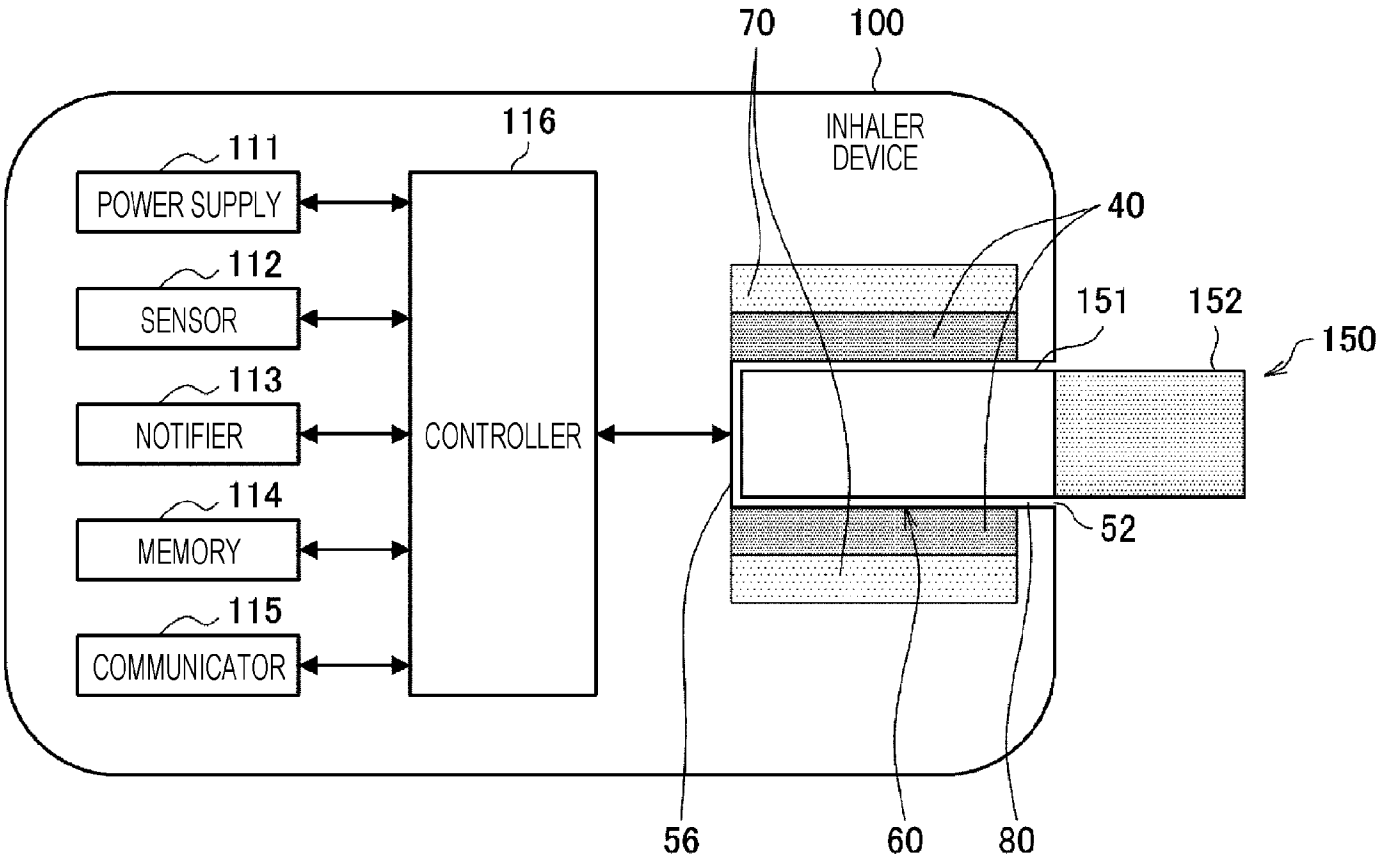
FIG. 1 is a schematic diagram of an inhaler device according to a configuration example.

A preferred embodiment of the present invention will be described in detail hereinafter with reference to the accompanying drawings. In the specification and the drawings, structural elements having substantially the same functional configuration are denoted by the same reference numerals, and redundant description thereof will be omitted.

<<1. Configuration Example of Inhaler Device>>

An inhaler device generates material to be inhaled by a user. In the example described below, the material generated by the inhaler device is an aerosol. Alternatively, the material generated by the inhaler device may be gas.

FIG. 1 is a schematic diagram of an inhaler device according to a configuration example. As illustrated in FIG. 1, an inhaler device 100 according to the present configuration example includes a power supply 111, a sensor 112, a notifier 113, a memory 114, a communicator 115, a controller 116, a heater 40, a holder 60, and a heat insulator 70.

The power supply 111 stores electric power. The power supply 111 supplies electric power to the structural elements of the inhaler device 100 under the control of the controller 116. The power supply 111 may be a rechargeable battery such as a lithium ion secondary battery.

The sensor 112 acquires various items of information regarding the inhaler device 100. In an example, the sensor 112 may be a pressure sensor such as a condenser microphone, a flow sensor, or a temperature sensor, and acquire a value generated in accordance with the user's inhalation. In another example, the sensor 112 may be an input device that receives information input by the user, such as a button or a switch.

The notifier 113 provides information to the user. The notifier 113 may be a light-emitting device that emits light, a display device that displays an image, a sound output device that outputs sound, or a vibration device that vibrates.

The memory 114 stores various items of information for operation of the inhaler device 100. The memory 114 may be a non-volatile storage medium such as flash memory.

The communicator 115 is a communication interface capable of communication in conformity with any wired or wireless communication standard. Such a communication standard may be, for example, Wi-Fi (registered trademark) or Bluetooth (registered trademark).

The controller 116 functions as an arithmetic processing unit and a control circuit, and controls the overall operations of the inhaler device 100 in accordance with various programs. The controller 116 includes an electronic circuit such as a central processing unit (CPU) and a microprocessor, for example.

The holder 60 holds a stick substrate 150. The holder 60 holds the stick substrate 150 inserted into an internal space 80 formed in the inhaler device 100 through an opening 52 that allows the internal space 80 to communicate with an external space.

The stick substrate 150 includes a substrate 151 and an inhalation port 152. The substrate 151 includes an aerosol source. The aerosol source is atomized to generate an aerosol. The aerosol source is a liquid such as polyhydric alcohol and water. Examples of the polyhydric alcohol include glycerine and propylene glycol. The aerosol source may include a flavor component that is either derived from tobacco or not derived from tobacco. For the inhaler device 100 that is a medical inhaler such as a nebulizer, the aerosol source may include a medicine. The aerosol source is not limited to a liquid, and may be a solid. The stick substrate 150 held by the holder 60 includes the substrate 151 at least partially accommodated in the internal space 80 and the inhalation port 152 at least partially protruding from the opening 52. When the user inhales with the inhalation port 152 protruding from the opening 52 in his/her mouth, an aerosol generated from the substrate 151 reaches inside the mouth of the user.

The heater 40 heats the aerosol source to atomize the aerosol source and generate the aerosol. In an example, the heater 40 has a film-like shape and surrounds the outer circumference of the holder 60. Subsequently, heat produced from the heater 40 heats the substrate 151 of the stick substrate 150 from the outer circumference, generating the aerosol. The heater 40 produces heat when receiving electric power from the power supply 111.

The heat insulator 70 prevents heat from transferring from the heater 40 to the other structural elements. For example, the heat insulator 70 may be a vacuum heat insulator or an aerogel heat insulator.

In the following, inhalation of an aerosol generated by an inhaler device by the user is simply referred to also as "inhalation" or "puff". Further, an action of inhalation by a user is hereinafter also referred to as a puff action.

<<2. Technical Features>>

(1) Configuration for Heating Substrate while Pressing Substrate

The inhaler device 100 according to the present embodiment has a configuration for heating the stick substrate 150 while pressing the stick substrate 150. This configuration will be described in detail hereinafter.

Figure 2:
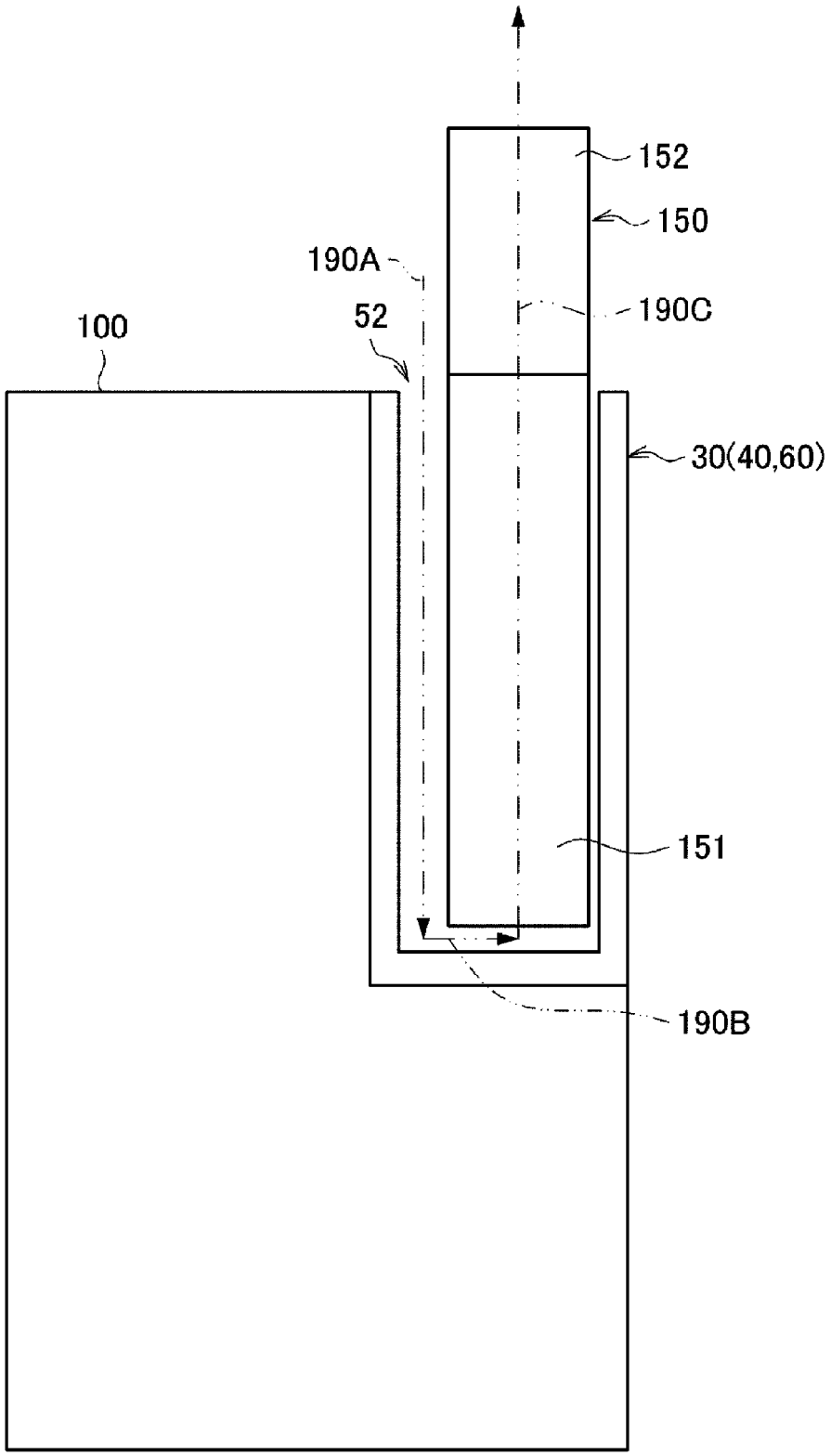
FIG. 2 is a diagram schematically illustrating a physical configuration of an inhaler device according to the present embodiment.

FIG. 2 is a diagram schematically illustrating a physical configuration of the inhaler device 100 according to the present embodiment. As illustrated in FIG. 2, the inhaler device 100 has a heater assembly 30. The heater assembly 30 includes the heater 40 and the holder 60. As illustrated in FIG. 2, a gap is formed between the heater assembly 30 and the stick substrate 150 held by the heater assembly 30 (more specifically, by the holder 60). When the user inhales with the stick substrate 150 in his/her mouth, air flowing in from the opening 52 flows into the stick substrate 150 from an end of the substrate 151 through the gap, and flows out into the mouth of the user from an end of the inhalation port 152. In other words, the air inhaled by the user flows in the order of an air flow 190A, an air flow 190B, and an air flow 190C, and is introduced into the oral cavity of the user in the mixture with the aerosol generated from the stick substrate 150.

Figure 3:
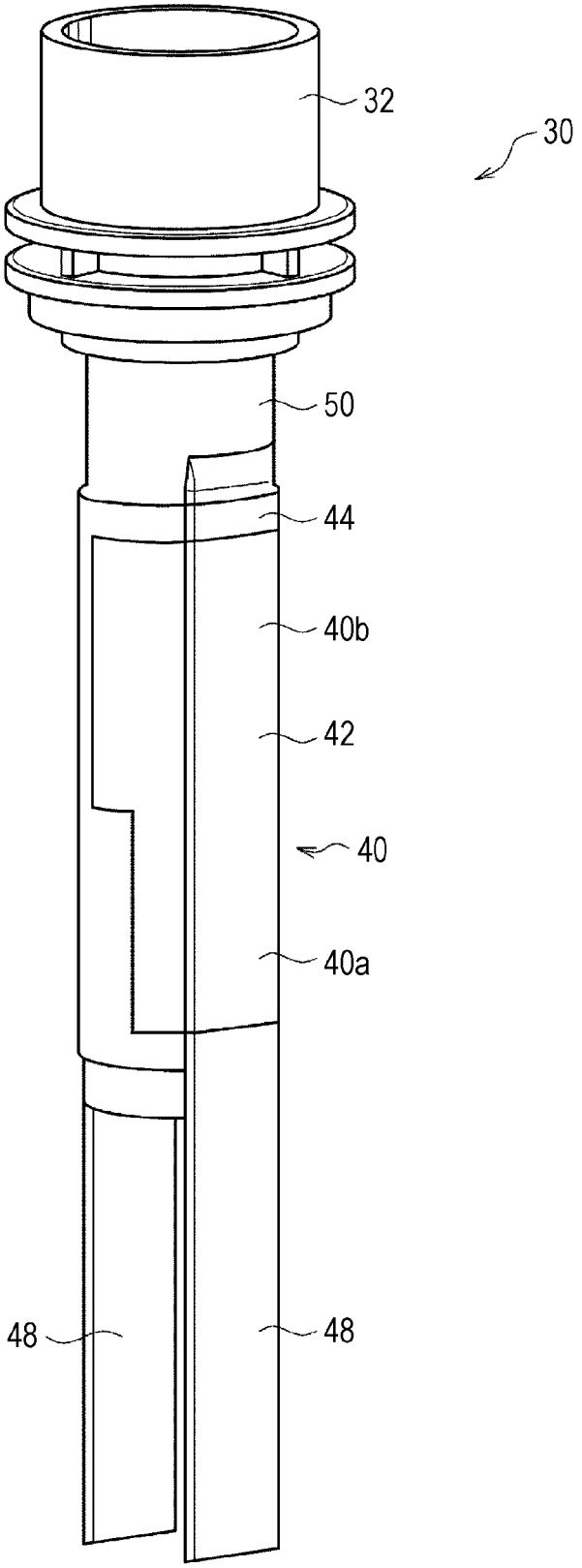
FIG. 3 is a perspective view of a heater assembly illustrated in FIG. 2.

FIG. 3 illustrates a perspective view of the heater assembly 30 illustrated in FIG. 2. As illustrated in FIG. 3, the heater assembly 30 includes a top cap 32, the heater 40, and a chamber 50. The chamber 50 is configured to receive the stick substrate 150. The heater 40 is configured to heat the stick substrate 150 received in the chamber 50. The top cap 32 may have a function of a guide for inserting the stick substrate 150 into the chamber 50, and may be configured to fix the chamber 50 to the inhaler device 100.

Figure 4:
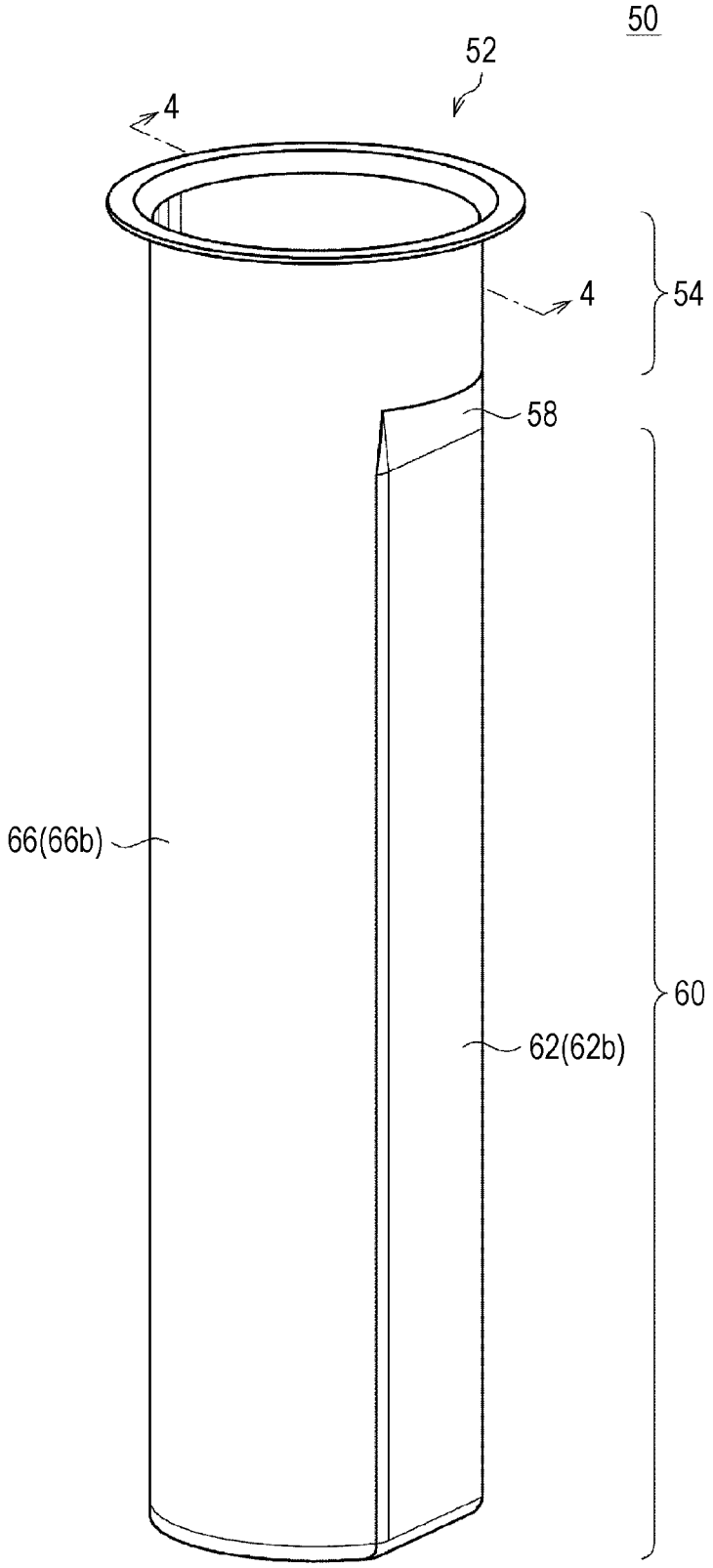
FIG. 4 is a perspective view of a chamber.
Figure 5:
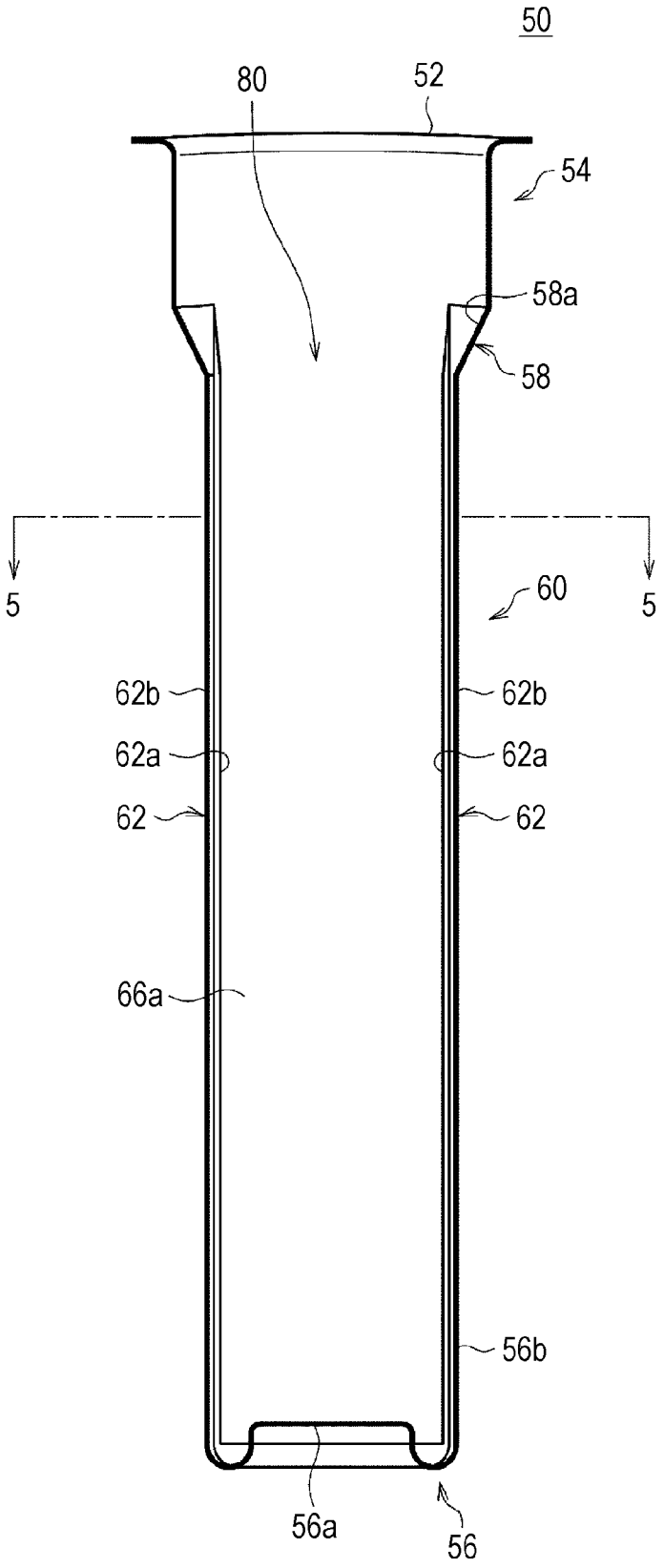
FIG. 5 is a cross-sectional view of the chamber, taken along arrowed line 4-4 illustrated in FIG. 4.
Figure 6:
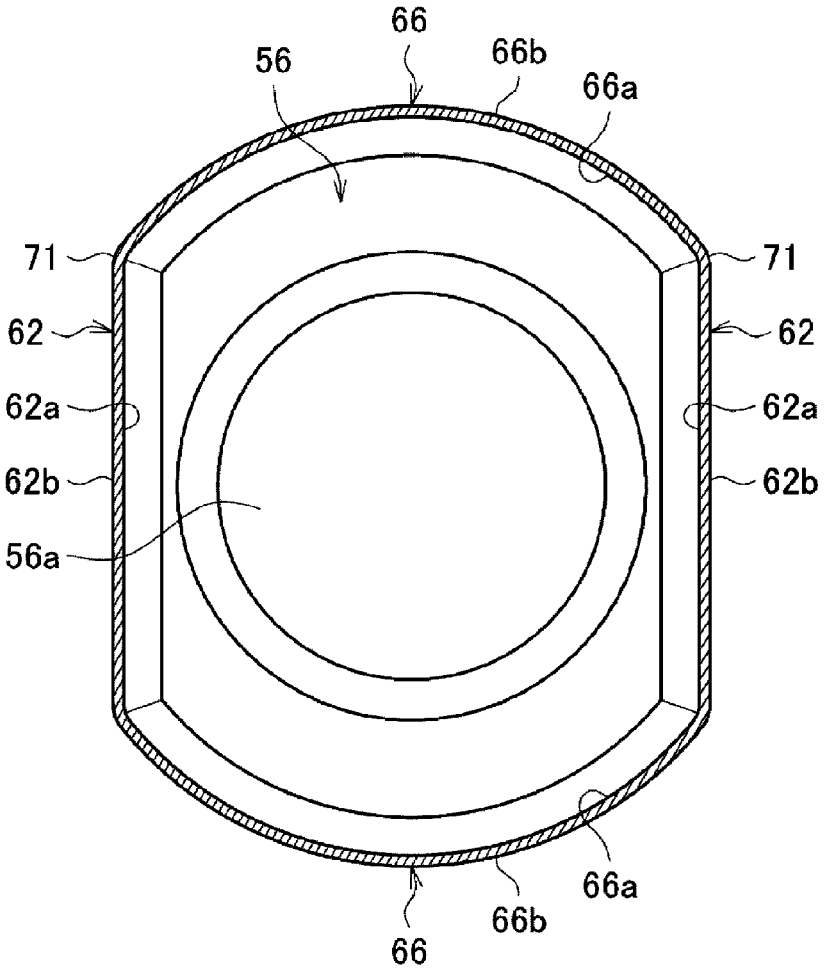
FIG. 6 is a cross-sectional view of the chamber, taken along arrowed line 5-5 illustrated in FIG. 5.

FIG. 4 illustrates a perspective view of the chamber 50. FIG. 5 illustrates a cross-sectional view of the chamber 50, taken along arrowed line 4-4 illustrated in FIG. 4. FIG. 6 illustrates a cross-sectional view of the chamber 50, taken along arrowed line 5-5 illustrated in FIG. 5. As illustrated in FIG. 4 and FIG. 5, the chamber 50 includes the opening 52, into which the stick substrate 150 is to be inserted, and the holder 60 that holds the stick substrate 150. The chamber 50 is formed as a hollow member that surrounds the internal space 80 that receives the stick substrate 150. The hollow member may be a tubular member with a bottom. The hollow member may be a tubular body without a bottom. The chamber 50 is preferably made of a metal having high thermal conductivity. For example, the chamber 50 may be formed of stainless steel. This enables effective heating of the stick substrate 150 from the chamber 50.

As illustrated in FIG. 5 and FIG. 6, the holder 60 includes a pressing portion 62 configured to press a portion of the stick substrate 150. The holder 60 further includes a non-pressing portion 66. The pressing portion 62 has an inner surface 62*a* and an outer surface 62*b*. The non-pressing portion 66 has an inner surface 66*a* and an outer surface 66*b*. As illustrated in FIG. 3, the heater 40 is disposed on the outer surface 62*b* of the pressing portion 62. Preferably, the heater 40 is disposed on the outer surface 62*b* of the pressing portion 62 without a gap.

The opening 52 of the chamber 50 is preferably capable of receiving the stick substrate 150 without the stick substrate 150 being pressed. The opening 52 of the chamber 50 may have a polygonal or elliptical shape in a plane orthogonal to the longitudinal direction of the chamber 50, in other words, in the direction in which the stick substrate 150 is inserted into the chamber 50 or the direction in which the entire side surface of the chamber 50 extends. Preferably, the opening 52 has a circular shape.

As illustrated in FIG. 4, FIG. 5, and FIG. 6, in the present embodiment, the chamber 50 includes two or more pressing portions 62 in the circumferential direction of the chamber 50. As illustrated in FIG. 5 and FIG. 6, the two pressing portions 62 of the holder 60 face each other. Preferably, the distance between at least portions of the inner surfaces 62*a* of the two pressing portions 62 is smaller than the width of a portion of the stick substrate 150 inserted into the chamber 50, the portion of the stick substrate 150 being between the pressing portions 62. As illustrated, the inner surfaces 62*a* of the pressing portions 62 are flat surfaces.

As illustrated in FIG. 6, the inner surfaces 62*a* of the pressing portions 62 have a pair of opposing flat pressing surfaces having a flat surface shape. The inner surface 66*a* of the non-pressing portion 66 has a pair of opposing curved non-pressing surfaces having a curved surface shape. The pair of curved non-pressing surfaces connects both ends of the pair of flat pressing surfaces. As illustrated, the curved non-pressing surfaces may have a generally arcuate cross-section in the plane orthogonal to the longitudinal direction of the chamber 50. As illustrated in FIG. 6, the holder 60 is a metal tubular body having a uniform thickness.

Figure 7:
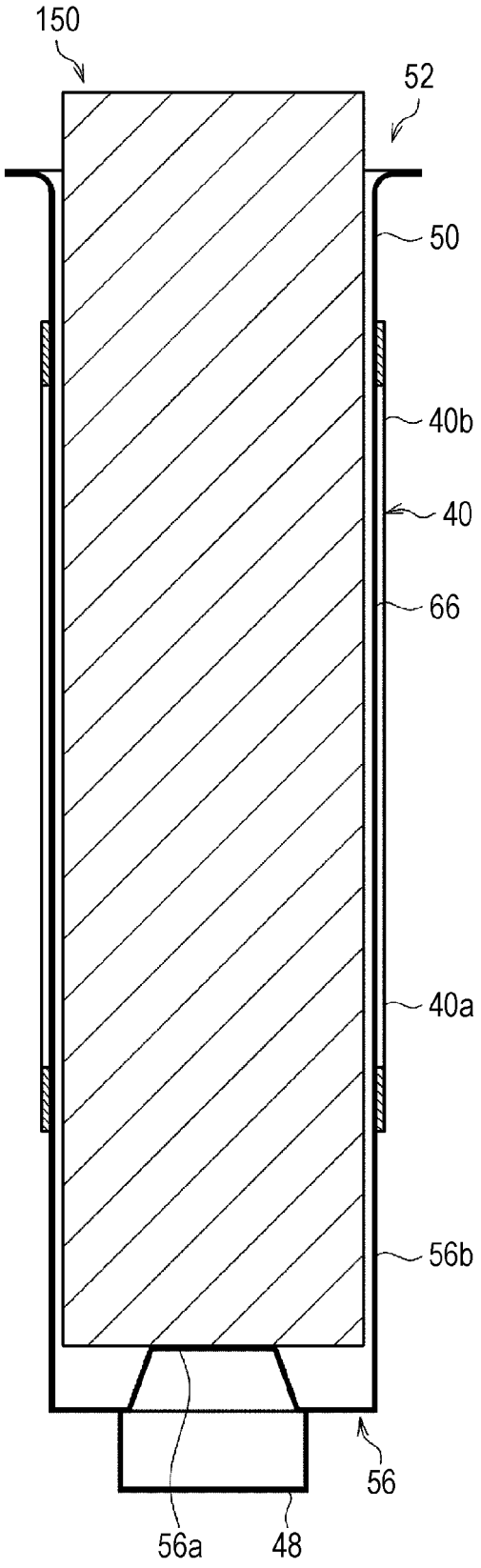
FIG. 7 is a longitudinal cross-sectional view of the chamber including a non-pressing portion while a stick substrate remains held by a holder.
Figure 8:
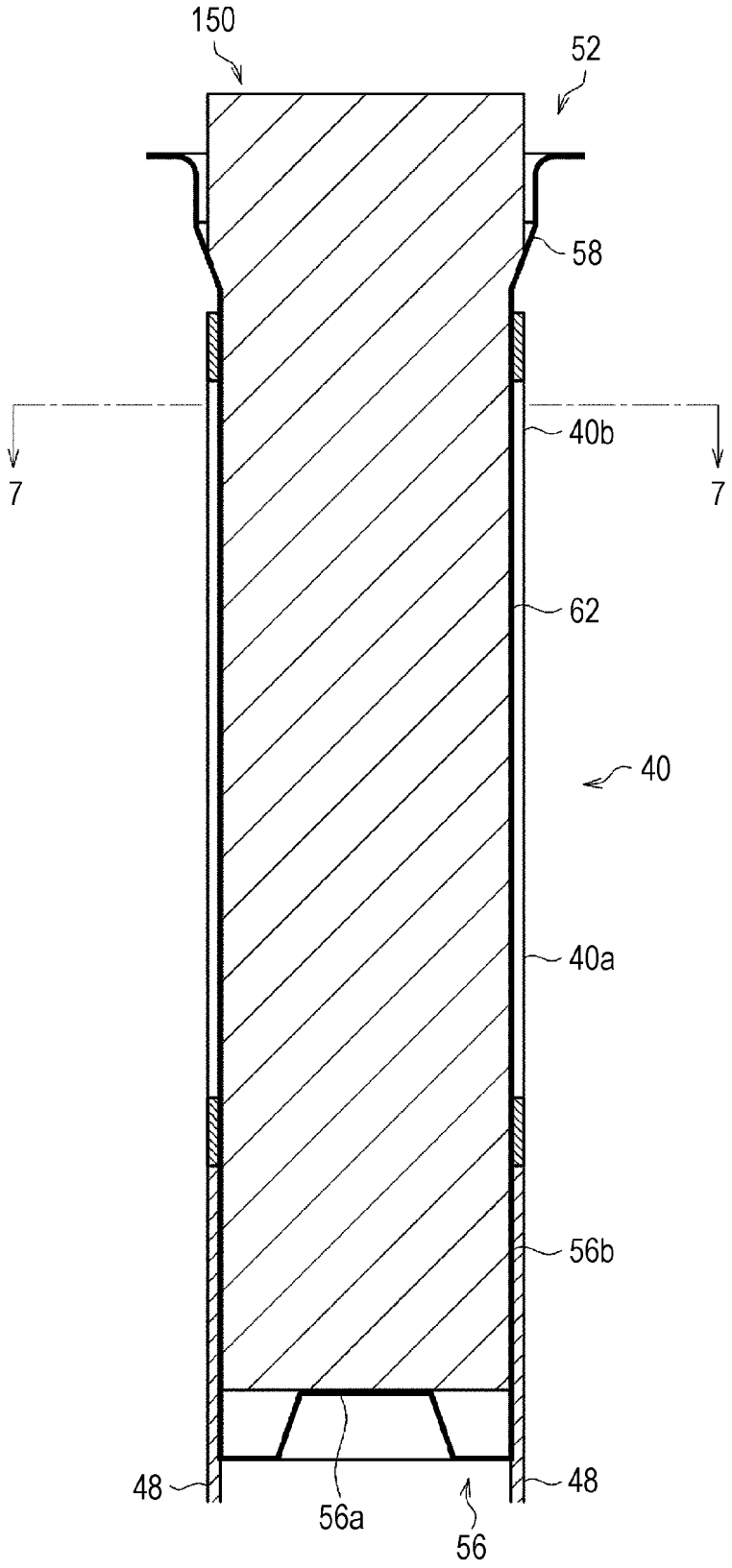
FIG. 8 is a longitudinal cross-sectional view of the chamber including a pressing portion while the stick substrate remains held by the holder.
Figure 9:
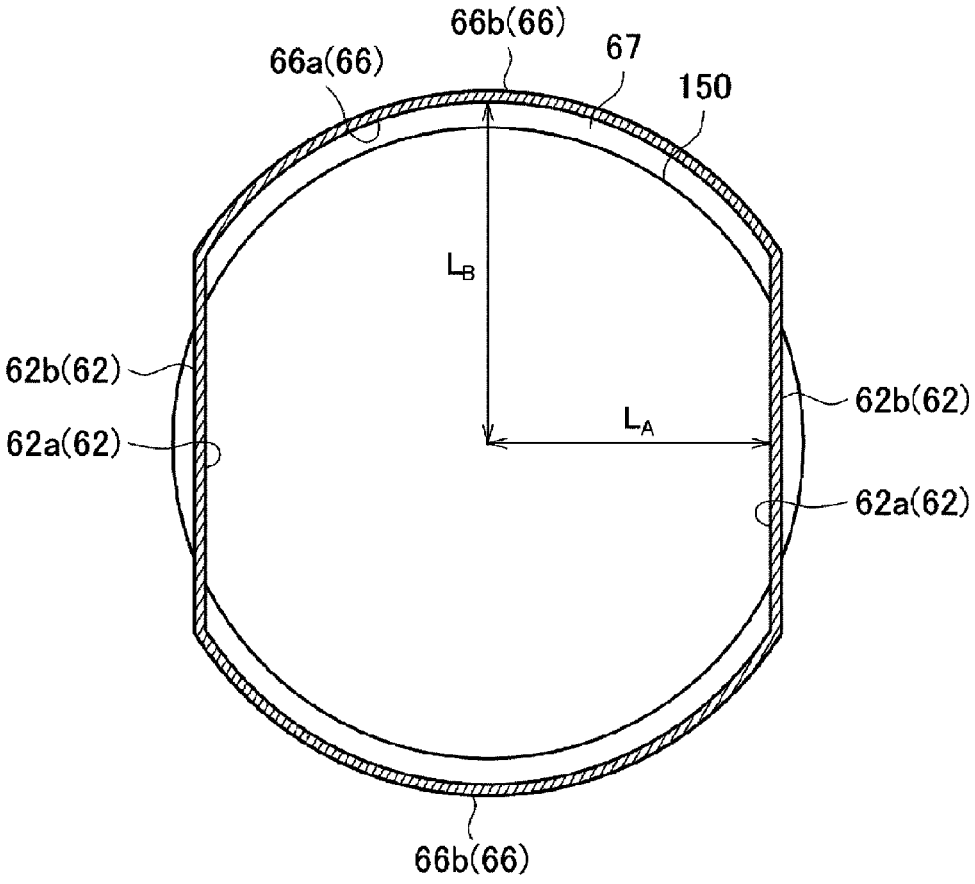
FIG. 9 is a cross-sectional view of the chamber, taken along arrowed line 7-7 illustrated in FIG. 8.

FIG. 7 is a longitudinal cross-sectional view of the chamber 50 including the non-pressing portion 66 while the stick substrate 150 remains held by the holder 60. FIG. 8 is a longitudinal cross-sectional view of the chamber 50 including the pressing portions 62 while the stick substrate 150 remains held by the holder 60. FIG. 9 is a cross-sectional view of the chamber 50, taken along arrowed line 7-7 illustrated in FIG. 8. FIG. 9 illustrates a cross section of the stick substrate 150 before pressing of the stick substrate 150 to help understand that the stick substrate 150 is pressed at the pressing portions 62.

Referring to FIG. 9, a gap 67 between the inner surface 66*a* of the non-pressing portion 66 and the stick substrate 150 is substantially maintained even when the stick substrate 150 held by the holder 60 is pressed at the pressing portions 62 and is deformed. The gap 67 can communicate with the opening 52 of the chamber 50 and an end surface of the stick substrate 150 that is in the chamber 50 (a lower end surface of the stick substrate 150 in FIG. 7 and FIG. 8, that is, an end surface of the substrate 151). In other words, the gap 67 can communicate with the opening 52 of the chamber 50 and the end surface of the stick substrate 150 that is in the chamber 50 at a position farther from the opening 52 of the chamber 50 (the lower end surface of the stick substrate 150 in FIG. 7 and FIG. 8, that is, the end surface of the substrate 151). A flow path of air is formed from the opening 52 of the chamber 50 to an end surface of the stick substrate 150 that is outside the chamber 50 (an upper end surface of the stick substrate 150 in FIG. 7 and FIG. 8, that is, an end surface of the inhalation port 152) such that the air passes through the gap 67 and the inside of the stick substrate 150. This eliminates the need to provide a separate flow path for the inhaler device 100 to introduce air to be supplied to the stick substrate 150, and can simplify the structure of the inhaler device 100. In addition, a portion of the non-pressing portion 66 that forms part of the gap 67 is exposed, which enables easy cleaning of the flow path. Furthermore, air is heated during passage of the air through the gap 67, which makes effective use of heat radiation from the heater 40 to improve heating efficiency. In addition, it is possible to prevent an excessive temperature drop of the stick substrate 150 due to an air inflow caused by a puff. As a result, it is possible to reduce the electric power consumption of the heater 40 and to prevent the reduction in flavor caused by the temperature drop of the stick substrate 150 in response to a puff. In terms of ventilation resistance and the like, the gap 67 between the inner surface 66*a* of the non-pressing portion 66 and the stick substrate 150 has a height of preferably 0.1 mm or more and 1.0 mm or less, more preferably 0.2 mm or more and 0.8 mm or less, and most preferably 0.3 mm or more and 0.5 mm or less.

As illustrated in FIG. 9, while the stick substrate 150 remains held by the holder 60, a distance $L_A$ between the inner surface 62*a* of each of the pressing portions 62 and the center of the stick substrate 150 is shorter than a distance $L_B$ between the inner surface 66*a* of the non-pressing portion 66 and the center of the stick substrate 150. This configuration can make the distance between the heater 40 on the outer surface 62*b* of each of the pressing portions 62 and the center of the stick substrate 150 shorter than the distance between the heater 40 and the center of the stick substrate 150 in a configuration that does not include the pressing portions 62. Thus, the heating efficiency of the stick substrate 150 can be increased.

As illustrated in FIG. 4 to FIG. 8, the chamber 50 has a bottom 56. As illustrated in FIG. 8, the bottom 56 supports a portion of the stick substrate 150 inserted into the chamber 50 at a bottom wall 56*a* such that at least a portion of the end surface of the stick substrate 150 can be exposed. The bottom 56 can support a portion of the stick substrate 150 at the bottom wall 56*a* such that the exposed portion of the end surface of the stick substrate 150 communicates with the gap 67.

As illustrated in FIG. 5, FIG. 7, and FIG. 8, the bottom 56 of the chamber 50 has the bottom wall 56*a* and may have a side wall 56*b* in addition to the bottom wall 56*a*. The bottom 56 defined by the side wall 56*b* has a width that may decrease toward the bottom wall 56*a*. As illustrated in FIG. 6 and FIG. 9, the inner surface 66*a* of the non-pressing portion 66 of the holder 60 is curved in the plane orthogonal to the longitudinal direction of the chamber 50.

The shape of the inner surface 66*a* of the non-pressing portion 66 in the plane orthogonal to the longitudinal direction of the chamber 50 and the shape of the opening 52 in the plane orthogonal to the longitudinal direction of the chamber 50 are preferably the same at any position in the longitudinal direction of the chamber 50. In other words, the inner surface 66*a* of the non-pressing portion 66 is preferably formed by extending the inner surface of the chamber 50, which forms the opening 52, in the longitudinal direction.

As illustrated in FIG. 3 to FIG. 5, the chamber 50 preferably has a tubular non-holder 54 between the opening 52 and the holder 60. While the stick substrate 150 remains held by the holder 60, a gap may be formed between the non-holder 54 and the stick substrate 150.

As illustrated in FIG. 5 to FIG. 9, an outer circumferential surface of the holder 60 preferably has the same shape and size (length of the outer circumference of the holder 60 in a plane orthogonal to the longitudinal direction of the holder 60) over the entire length in the longitudinal direction of the holder 60.

Further, as illustrated in FIG. 4 and FIG. 5, the chamber 50 preferably has first guides 58 having tapered surfaces 58*a* that connect the inner surface of the chamber 50, which forms the opening 52, and the inner surfaces 62*a* of the pressing portions 62.

As illustrated in FIG. 3, the heater 40 includes a heating element 42. The heating element 42 may be a heating track, for example. For example, as illustrated in FIG. 6, each of the outer surfaces 62*b* of the pressing portions 62 and the outer surface 66*b* of the non-pressing portion 66 may be connected to each other at an angle, and a boundary 71 may be formed between each of the outer surfaces 62*b* of the pressing portions 62 and the outer surface 66*b* of the non-pressing portion 66. The heating track preferably extends in a direction crossing the direction in which the boundaries 71 extend (the longitudinal direction of the chamber 50), and preferably extends in a direction perpendicular to the direction in which the boundaries 71 extend.

As illustrated in FIG. 3, the heater 40 preferably includes, in addition to the heating element 42, an electrically insulating member 44 that covers at least one surface of the heating element 42. In this embodiment, the electrically insulating member 44 is disposed so as to cover both surfaces of the heating element 42. The electrically insulating member 44 is preferably disposed in a region on the outer surface of the holder 60. In other words, the electrically insulating member 44 is preferably disposed so as not to protrude from the outer surface of the holder 60 on the side of the chamber 50 adjacent to the first guides 58 in the longitudinal direction of the chamber 50. As described above, due to the first guides 58 between the opening 52 and the pressing portions 62, the shape of the outer surface of the chamber 50 and the length of the outer circumference of the chamber 50 in the plane orthogonal to the longitudinal direction of the chamber 50 may change in the longitudinal direction of the chamber 50. The electrically insulating member 44 on the outer surface of the holder 60 can prevent the occurrence of sagging.

Preferably, the heater 40 is not disposed on at least one selected from the portion of the outer surface of the chamber 50 between the opening 52 and each of the first guides 58, that is, an outer surface of the non-holder 54, an outer surface of each of the first guides 58, and the outer surface of the non-pressing portion 66. The heater 40 is preferably disposed over the entire outer surface 62*b* of each of the pressing portions 62.

In the present embodiment, as illustrated in FIG. 3, the inhaler device 100 includes strip-shaped electrodes 48 that extend from the heaters 40. The strip-shaped electrodes 48 preferably extend beyond the outer surfaces 62*b* of the pressing portions 62 from the outer surfaces 62*b* of the pressing portions 62, which are flat, with the heaters 40 disposed on the outer surfaces 62*b* of the pressing portions 62.

As illustrated in FIG. 3, FIG. 7, and FIG. 8, the heater 40 has a first portion 40*a* and a second portion 40*b*. The first portion 40*a* is located on the side of the heater 40 farther from the opening 52. The second portion 40*b* is located on the side of the heater 40 closer to the opening 52. The second portion 40*b* preferably has a higher heater power density than the first portion 40*a*. Alternatively, the second portion 40*b* preferably has a higher temperature rise rate than the first portion 40*a*. Alternatively, the second portion 40*b* preferably has a higher heating temperature than the first portion 40*a* at any same time. The second portion 40*b* preferably covers a portion of the outer surface of the holder 60 corresponding to ½ or more of a smokable material included in the stick substrate 150 in the longitudinal direction of the smokable material while the stick substrate 150 remains held by the holder 60.

In the embodiment described above, the chamber 50 includes a pair of opposing pressing portions 62. However, the chamber 50 may have any other shape. For example, the chamber 50 may include one pressing portion 62 or three or more pressing portions 62.

As described above, the inhaler device 100 according to the present embodiment holds and heats the stick substrate 150 while the stick substrate 150 is pressed with the pressing portions 62. This configuration can achieve following various effects.

First, the thermal conductivity from the heater 40 to the stick substrate 150 is improved. In other words, the heating efficiency of the stick substrate 150 can be improved. The improved heating efficiency of the stick substrate 150 allows the temperature of the stick substrate 150 to rapidly reach a target temperature, and thus can reduce the time taken for preheating described below. The improved heating efficiency of the stick substrate 150 further allows improvement in the followability of the temperature of the stick substrate 150 in response to a temperature change of the heater 40. As a result, first, the amount of aerosol generated can be more easily controlled. Second, even if the temperature of the stick substrate 150 decreases with a puff taken by the user, the temperature can be immediately returned to the original temperature. Third, the influence of the external environment such as the outside air temperature can be reduced. Fourth, a temperature change similar to a temperature change in a heating profile described below can easily be achieved in the stick substrate 150. Fifth, the effect of improvement in flavor, which is an effect of a temperature re-rise section in the heating profile described below, can be rapidly implemented.

Further, the inhaler device 100 according to the present embodiment heats the stick substrate 150 from the outer circumference while pressing the stick substrate 150. This configuration can achieve the improvement in the heating efficiency of the stick substrate 150 and the improvement in the followability of the temperature of the stick substrate 150, described above, regardless of the shape of the aerosol source in the stick substrate 150. This configuration can also achieve the improvement in the heating efficiency of the stick substrate 150 and the improvement in the followability of the temperature of the stick substrate 150, described above, regardless of the error of the shape or the size of the stick substrate 150 caused by variation produced in the manufacturing process of the stick substrate 150. By contrast, these effects are difficult to achieve in a comparative example having a configuration in which a blade-shaped heater is inserted into the stick substrate 150 to heat the stick substrate 150 from inside. This is because, in the comparative example, it is difficult to bring the blade-shaped heater and the aerosol source in the stick substrate 150 into good contact with each other even when the stick substrate 150 is pressed from the outer circumference.

In the inhaler device 100 according to the present embodiment, furthermore, the heat insulator 70 surrounds the heater 40 from the outer circumference. In this arrangement, the outer surface 62*b* of the pressing portion 62 is positioned closer to the center of the internal space 80 than the outer surface 66*b* of the non-pressing portion 66, which can increase the thickness of an air layer formed between the outer surface 62*b* of the pressing portion 62 and an inner surface of the heat insulator 70. Alternatively, the thickness of the heat insulator 70 superimposed on the pressing portion 62 can be increased. Thus, the effect of heat insulation by the heat insulator 70 can be improved.

(2) Heating Profile

The inhaler device 100 controls the operation of the heater 40 in accordance with a heating profile. The heating profile is information that defines a time-series progression of a target temperature. The target temperature is a target value of the temperature of the heater 40. The inhaler device 100 controls the operation of the heater 40 so that the time-series progression of the target temperature defined in the heating profile can be implemented. Accordingly, an aerosol is generated according to a plan defined in the heating profile. The heating profile is typically designed so as to give an optimum flavor to the user when the user inhales the aerosol generated from the stick substrate 150. Thus, the operation of the heater 40 is controlled in accordance with the heating profile, which can give an optimum flavor to the user.

The controller 116 controls the operation of the heater 40 in accordance with the deviation of an actual temperature (hereinafter also referred to as a real temperature) of the heater 40 from the target temperature defined in the heating profile. More specifically, the controller 116 controls the operation of the heater 40 in accordance with the deviation of the real temperature from the target temperature corresponding to the elapsed time from the start of the control of the operation of the heater 40 based on the heating profile. The controller 116 controls the temperature of the heater 40 so that the time-series progression of the real temperature of the heater 40 becomes similar to the time-series progression of the target temperature of the heater 40 defined in the heating profile. The temperature control of the heater 40 can be implemented by known feedback control, for example. Specifically, the controller 116 causes electric power from the power supply 111 to be supplied to the heater 40 in the form of pulses based on pulse width modulation (PWM) or pulse frequency modulation (PFM). In this case, the controller 116 can adjust the duty ratio of electric power pulses to perform the temperature control of the heater 40.

In the feedback control, it is desirable that the controller 116 control electric power to be supplied to the heater 40, for example, the duty ratio described above, based on a difference between the real temperature and the target temperature or the like. The feedback control may be, for example, proportional-integral-differential controller (PID control). Alternatively, the controller 116 may perform simple ON-OFF control. For example, the controller 116 may cause the heater 40 to perform heating until the real temperature reaches the target temperature, cause the heater 40 to stop heating in response to the real temperature reaching the target temperature, and cause the heater 40 to perform heating again if the real temperature becomes lower than the target temperature.

The temperature of the heater 40 can be determined by, for example, measuring or estimating an electrical resistance value of a heating resistor of the heater 40. This is because the electrical resistance value of the heating resistor changes with temperature. The electrical resistance value of the heating resistor can be estimated by, for example, measuring an amount of voltage drop across the heating resistor. The amount of voltage drop across the heating resistor can be measured by a voltage sensor that measures a potential difference to be applied to the heating resistor. In another example, the temperature of the heater 40 may be measured by a temperature sensor installed near the heater 40.

The heating based on the heating profile is started at a timing when the execution of an operation of giving an instruction to start heating is detected. An example of the operation of giving an instruction to start heating is pressing of a button on the inhaler device 100. Another example of the operation of giving an instruction to start heating is a puff action. Another example of the operation of giving an instruction to start heating is reception of a signal from another device such as a smartphone.

After the start of heating, the amount of the aerosol source contained in the substrate gradually decreases with time. Typically, the heating by the heater 40 is stopped at a timing when the aerosol source is expected to be exhausted. An example of the timing when the aerosol source is expected to be exhausted is a timing at which a predetermined amount of time has elapsed since the start of the control of the operation of the heater 40 based on the heating profile. An example of the timing when the aerosol source is expected to be exhausted is a timing at which a predetermined number of puffs are detected. An example of the timing when the aerosol source is expected to be exhausted is a timing at which a button on the inhaler device 100 is pressed. The button is pressed when, for example, the user no longer obtains sufficient flavor.

A period during which a sufficient amount of aerosol is expected to be generated is also referred to as a puffable period. A period from the start of heating to the start of the puffable period is also referred to as a preheating period. The heating performed in the preheating period is also referred to as preheating. The user may be notified of the timing of the start of the puffable period and the timing of the end of the puffable period. In this case, the user can take a puff in the puffable period while referring to the notification.

The controller 116 controls the operation of the heater 40 in accordance with how the stick substrate 150 is held by the holder 60. Specifically, the controller 116 controls the operation of the heater 40 so that the stick substrate 150 is heated in accordance with the heating profile with a portion of the stick substrate 150 being pressed at the pressing portion 62 of the holder 60. In other words, the controller 116 adjusts the amount of electric power to be supplied to the heater 40 in accordance with the target temperature corresponding to the elapsed time from the start of the control of the operation of the heater 40 based on the heating profile with a portion of the stick substrate 150 being pressed at the pressing portion 62 of the holder 60, and controls the heating of the stick substrate 150 by the heater 40. At this time, the controller 116 may further adjust the amount of electric power in accordance with the strength of pressing at the pressing portion 62. The controller 116 may control the operation of the heater 40 so as not to heat the stick substrate 150 in accordance with the heating profile (for example, so as not to supply electric power to the heater 40) while a portion of the stick substrate 150 does not remain pressed at the pressing portion 62 of the holder 60. In consideration of improvement in the heating efficiency of the stick substrate 150 due to pressing, this configuration allows the operation of the heater 40 to be controlled in accordance with the degree of improvement in the heating efficiency of the stick substrate 150. It is thus possible to provide a puff experience of sufficient quality to the user.

The heating profile includes a plurality of time sections that are continuous along a time axis. Each of the plurality of time sections is assigned the target temperature such that a target temperature at an end of the time section is set for the time section. The controller 116 controls the operation of the heater 40 in accordance with the deviation of the real temperature from the target temperature set for the time section corresponding to the elapsed time from the start of the control of the operation of the heater 40 based on the heating profile among the plurality of time sections. Specifically, the controller 116 controls the operation of the heater 40 so that the set target temperature is reached by an end of each of the plurality of time sections included in the heating profile. An example of the heating profile is presented in Table 1 below.

TABLE 1

Example of heating profile

| Time section | Time length | Target temperature |
|---|---|---|
| Initial temperature rise section | 35 sec | 295° C. |
| Intermediate temperature drop section | 10 sec | 230° C. |
| Temperature re-rise section | 310 sec | 260° C. |

The heating profile presented in Table 1 includes an initial temperature rise section, an intermediate temperature drop section, and a temperature re-rise section in sequence. In the example presented in Table 1, the initial temperature rise section is a section from the start of the heating profile to 35 seconds later. The intermediate temperature drop section is a section from the end of the initial temperature rise section to 10 seconds later. The temperature re-rise section is a section from the end of the intermediate temperature drop section to 310 seconds later. The heating profile including these time sections makes it possible to provide a puff experience of sufficient quality to the user over a period from the beginning to the end of the heating profile, as described below. In other words, the quality of the puff experience of the user can be improved.

The initial temperature rise section is a time section included at the beginning of the heating profile. The target temperature set for the initial temperature rise section is higher than an initial value. The initial value is a temperature expected as the temperature of the heater 40 before the start of heating. An example of the initial value is any temperature such as 0° C. Another example of the initial value is a temperature corresponding to an ambient temperature.

The intermediate temperature drop section is a time section included in the intermediate portion of the heating profile. The target temperature set for the intermediate temperature drop section is lower than the target temperature set for the time section immediately before the intermediate temperature drop section. In the example presented in Table 1, 230° C., which is the target temperature set for the intermediate temperature drop section, is lower than 295° C., which is the target temperature set for the immediately preceding time section, namely, the initial temperature rise section.

The temperature re-rise section is a time section included at the end of the heating profile. The target temperature set for the temperature re-rise section is higher than the target temperature set for the time section immediately before the temperature re-rise section. In the example presented in Table 1, 260° C., which is the target temperature set for the temperature re-rise section, is higher than 230° C., which is the target temperature set for the immediately preceding time section, namely, the intermediate temperature drop section.

Figure 10:
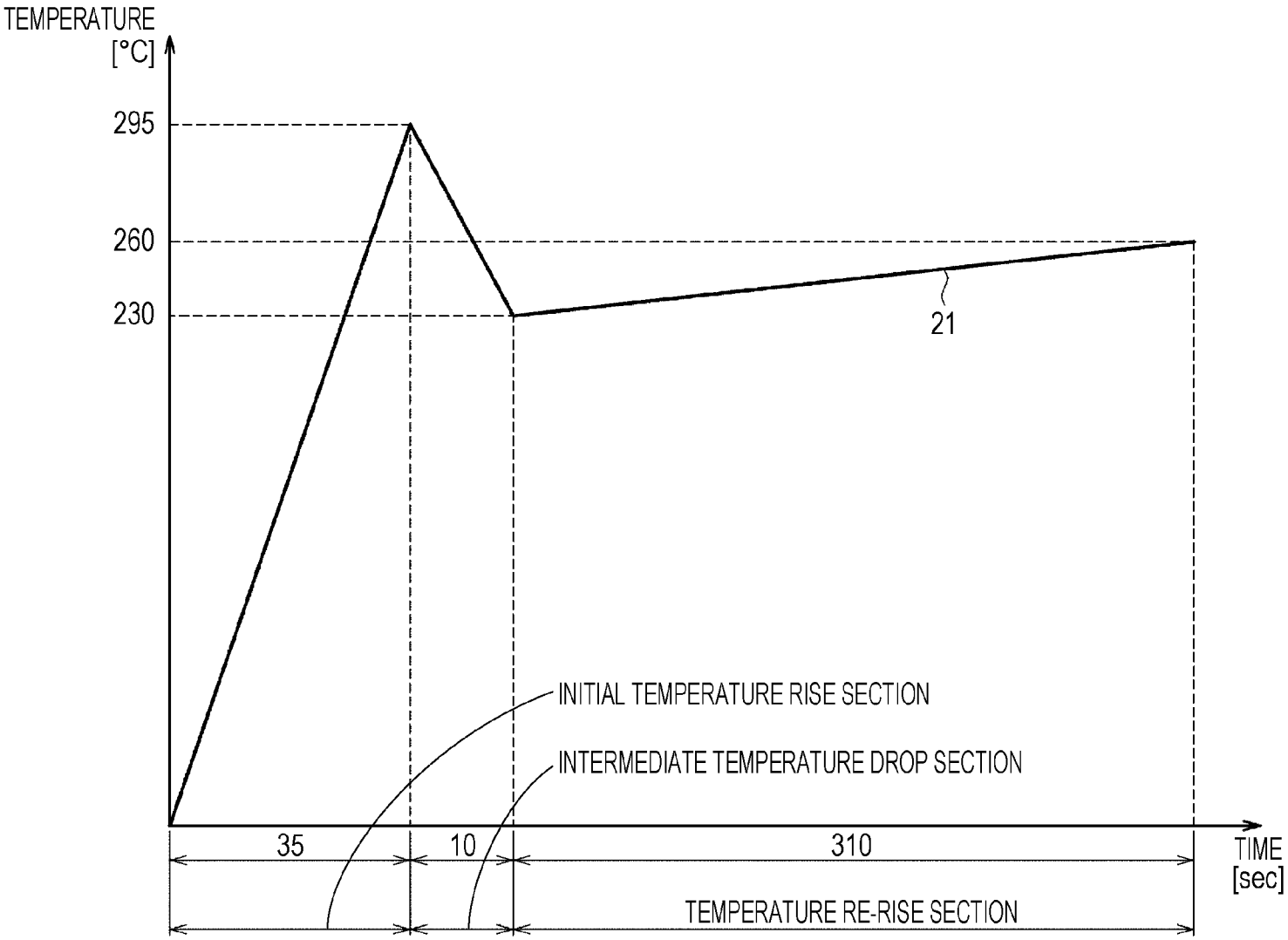
FIG. 10 is a graph illustrating an example of a time-series progression of a real temperature of a heater 40 that operates in accordance with a heating profile presented in Table 1.

A time-series progression of the real temperature of the heater 40 in a case where the controller 116 controls the operation of the heater 40 in accordance with the heating profile presented in Table 1 will be described with reference to FIG. 10. FIG. 10 is a graph illustrating an example of a time-series progression of the real temperature of the heater 40 that operates in accordance with the heating profile presented in Table 1. In the graph, the horizontal axis represents time (seconds). In the graph, the vertical axis represents the temperature of the heater 40. In the graph, a line 21 indicates a time-series change in the real temperature of the heater 40.

As illustrated in FIG. 10, the real temperature of the heater 40 rises in the initial temperature rise section, and reaches 295° C., which is the target temperature, at the end of the initial temperature rise section. When the real temperature of the heater 40 reaches the target temperature set for the initial temperature rise section, it is expected that the temperature of the stick substrate 150 reaches a temperature at which a sufficient amount of aerosol is generated. The initial temperature rise section is set at the beginning of the heating profile. In the initial temperature rise section, the temperature of the heater 40 is raised directly to 295° C., which is the target temperature set for the initial temperature rise section, from an initial temperature. The initial temperature is the real temperature of the heater 40 at the start of heating based on the heating profile. This configuration makes it possible to terminate preheating in the early stage.

The controller 116 performs the temperature control of the heater 40 so that in the initial temperature rise section, the real temperature reaches the target temperature set for the initial temperature rise section. That is, the controller 116 controls the temperature of the heater 40 from the initial temperature toward 295° C. If the real temperature reaches 295° C. before a period of 35 seconds elapses from the start of heating, the controller 116 controls the temperature of the heater 40 so that the temperature of the heater 40 is maintained at 295° C.

As illustrated in FIG. 10, the real temperature of the heater 40 drops in the intermediate temperature drop section, and reaches 230° C., which is the target temperature, at the end of the intermediate temperature drop section. The intermediate temperature drop section is set subsequent to the initial temperature rise section. In the intermediate temperature drop section, the temperature of the heater 40 temporarily drops from the set temperature for the initial temperature rise section to the set temperature for the intermediate temperature drop section. If the heater 40 is maintained at a high temperature such as the target temperature for the initial temperature rise section, the aerosol source contained in the stick substrate 150 is rapidly consumed, which inconveniences the user such that the user may be given an excessively strong flavor. In the present embodiment, by contrast, the intermediate temperature drop section can avoid the inconvenience described above, and the quality of the puff experience of the user can be improved.

The controller 116 performs control so that no electric power is supplied to the heater 40 in the intermediate temperature drop section. In other words, the controller 116 performs control to stop supply of electric power to the heater 40 in the intermediate temperature drop section so that no heating is performed by the heater 40. This configuration enables the real temperature of the heater 40 to drop most rapidly. It is also possible to reduce the electric power consumption of the inhaler device 100 compared to a case where electric power is supplied to the heater 40 even in the intermediate temperature drop section.

As illustrated in FIG. 10, the real temperature of the heater 40 rises in the temperature re-rise section, and reaches 260° C., which is the target temperature, at the end of the temperature re-rise section. The temperature re-rise section is set subsequent to the intermediate temperature drop section and at the end of the heating profile. In the temperature re-rise section, the temperature of the heater 40 is raised again from the set temperature for the intermediate temperature drop section to the set temperature for the temperature re-rise section, and then the heater 40 stops heating. If the temperature of the heater 40 is continuously decreased after the initial temperature rise section, the temperature of the stick substrate 150 is also decreased. As a result, the amount of aerosol generated is reduced, and the flavor that the user tastes may be deteriorated. In the present embodiment, by contrast, the temperature re-rise section provided after the intermediate temperature drop section can prevent deterioration of the flavor that the user tastes even in the latter half of the heating profile.

The controller 116 performs the temperature control of the heater 40 so that in the temperature re-rise section, the real temperature reaches the target temperature set for the temperature re-rise section. In other words, the controller 116 controls the temperature of the heater 40 toward 260° C. If the real temperature reaches 260° C. before a period of 310 seconds elapses from the start of the temperature re-rise section, the controller 116 controls the temperature of the heater 40 so that the temperature of the heater 40 is maintained at 260° C.

When compared among the initial temperature rise section, the intermediate temperature drop section, and the temperature re-rise section, an absolute value of an amount of change in the target temperature per unit time may be smallest in the temperature re-rise section, second smallest in the intermediate temperature drop section, and largest in the initial temperature rise section. The absolute value of the amount of change in target temperature per unit time in the initial temperature rise section is a value obtained by dividing an absolute value of a difference between the target temperature set for the initial temperature rise section and the initial value by a time length of the initial temperature rise section. The absolute value of the amount of change in target temperature per unit time in the intermediate temperature drop section is a value obtained by dividing an absolute value of a difference between the target temperature set for the intermediate temperature drop section and the target temperature set for the time section immediately before the intermediate temperature drop section (for example, the initial temperature rise section) by a time length of the intermediate temperature drop section. The absolute value of the amount of change in target temperature per unit time in the temperature re-rise section is a value obtained by dividing an absolute value of a difference between the target temperature set for the temperature re-rise section and the target temperature set for the time section immediately before the temperature re-rise section (for example, the intermediate temperature drop section) by a time length of the temperature re-rise section. When the time lengths of the initial temperature rise section, the intermediate temperature drop section, and the temperature re-rise section are compared, the time length of the intermediate temperature drop section is shortest, the time length of the initial temperature rise section is second shortest, and the time length of the temperature re-rise section is longest. With this configuration, as illustrated in FIG. 10, the temperature of the heater 40 rapidly rises in the initial temperature rise section, the heater 40 exits a high-temperature state in the early stage in the intermediate temperature drop section, and the temperature of the heater 40 slowly rises in the temperature re-rise section. It is thus possible to terminate preheating in the early stage and to provide a puff experience of sufficient quality to the user over a period from the beginning to the end of the heating profile.

The controller 116 may determine at least part of switching of the plurality of time sections in the heating profile in accordance with the real temperature of the heater 40. For example, the controller 116 may determine switching from the initial temperature rise section to the intermediate temperature drop section and the end of the temperature re-rise section in response to the deviation of the real temperature of the heater 40 from the target temperature set for each time section falling within a predetermined threshold.

The controller 116 may determine at least part of switching of the plurality of time sections in the heating profile in accordance with the elapsed time. For example, the controller 116 may determine the end of the intermediate temperature drop section in accordance with the elapsed time from the start of the intermediate temperature drop section. For example, in the heating profile illustrated in FIG. 10, the intermediate temperature drop section is set to 10 seconds. Accordingly, at a lapse of time of 10 seconds after the start of the intermediate temperature drop section, the controller 116 determines that switching to the temperature re-rise section is to be performed to resume heating by the heater 40. This configuration allows determination of switching from the intermediate temperature drop section to the temperature re-rise section without measurement of the temperature of the heater 40, and thus makes it possible to reduce the processing load on the controller 116. In addition, even a configuration for measuring the temperature of the heater 40 based on the electric resistance value of the heating resistor of the heater 40 makes it possible to determine switching to the temperature re-rise section while stopping supply of electric power to the heater 40 in the intermediate temperature drop section.

However, the real temperature of the heater 40 at the end of the intermediate temperature drop section may change depending on the external environment such as the outside air temperature. For example, when the heater 40 operates in accordance with the heating profile illustrated in FIG. 10, the real temperature of the heater 40 at the end of the intermediate temperature drop section may be 220° C. if the outside air temperature is low, and may be 240° C. if the outside air temperature is high.

Accordingly, the controller 116 controls the operation of the heater 40 in accordance with the real temperature of the heater 40 and the target temperature set for the intermediate temperature drop section at the start of the time section subsequent to the intermediate temperature drop section (that is, the temperature re-rise section). More specifically, the controller 116 supplies electric power to the heater 40 at a first duty ratio if the real temperature of the heater 40 is less than the target temperature set for the intermediate temperature drop section at the start of the time section subsequent to the intermediate temperature drop section. On the other hand, if the real temperature of the heater 40 is equal to or higher than the target temperature set for the intermediate temperature drop section at the start of the time section subsequent to the intermediate temperature drop section, the controller 116 supplies electric power to the heater 40 at a second duty ratio. The first duty ratio is larger than the second duty ratio. The duty ratio is the ratio of a period during which supply of electric power to the heater 40 is continued to a predetermined period. With this configuration, even if a deviation occurs between the target temperature and the real temperature of the heater 40 due to the influence of the external environment, the deviation can be rapidly reduced, and thus it is possible to suppress deterioration of the flavor that the user tastes.

(3) Process Flow

Figure 11:
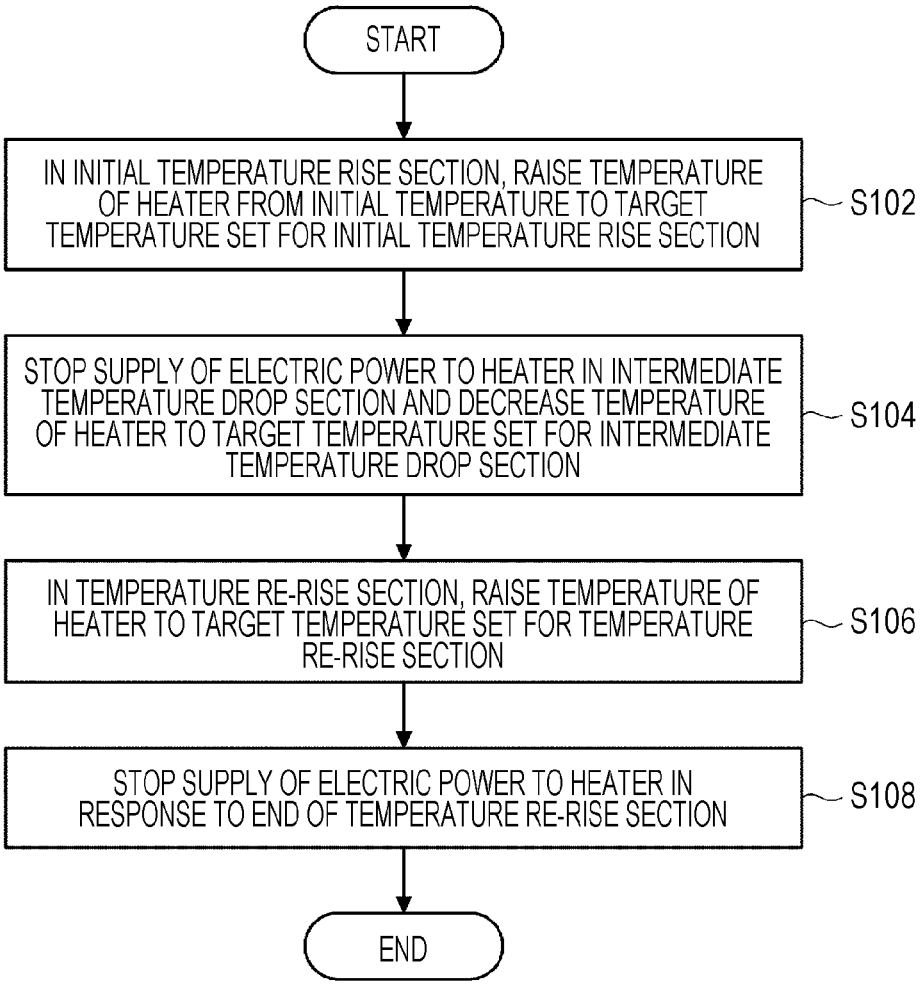
FIG. 11 is a flowchart illustrating an example of a process flow executed by the inhaler device according to the present embodiment.

FIG. 11 is a flowchart illustrating an example of a process flow executed by the inhaler device 100 according to the present embodiment.

As illustrated in FIG. 11, first, in the initial temperature rise section, the inhaler device 100 raises the temperature of the heater 40 from the initial temperature to the target temperature set for the initial temperature rise section (step S102).

Then, the inhaler device 100 stops supply of electric power to the heater 40 in the intermediate temperature drop section, and decreases the temperature of the heater 40 to the target temperature set for the intermediate temperature drop section (step S104).

Then, in the temperature re-rise section, the inhaler device 100 raises the temperature of the heater 40 to the target temperature set for the temperature re-rise section (step S106).

Then, the inhaler device 100 stops supply of electric power to the heater 40 in response to the end of the temperature re-rise section (step S108).

<<3. Modifications>>

<3.1. First Modification>

In the initial temperature rise section, the temperature of the stick substrate 150 is rapidly raised to a temperature at which a sufficient amount of aerosol is generated to shorten the preheating period. As a result, a phenomenon called overshoot, in which the temperature of the stick substrate 150 rises excessively, is likely to occur. An overshoot may cause a reduction in the life of the stick substrate 150 (specifically, the length of the puffable period) or delivery of a bad flavor to the user.

Accordingly, a first modification provides a heating profile in which the temperature rise width per unit time gradually decreases in the initial temperature rise section. This configuration may avoid an overshoot in the initial temperature rise section and makes it possible to improve the quality of the puff experience of the user. An example of the heating profile according to the present modification is presented in Table 2.

TABLE 2

Example of heating profile

| Time section | | Time length | Target temperature |
|---|---|---|---|
| Initial temperature rise section | First temperature rise section | 17 sec | 290° C. |
| | Second temperature rise section | 18 sec | 295° C. |
| Intermediate temperature drop section | | 10 sec | 230° C. |
| Temperature re-rise section | | 310 sec | 260° C. |

Figure 12:
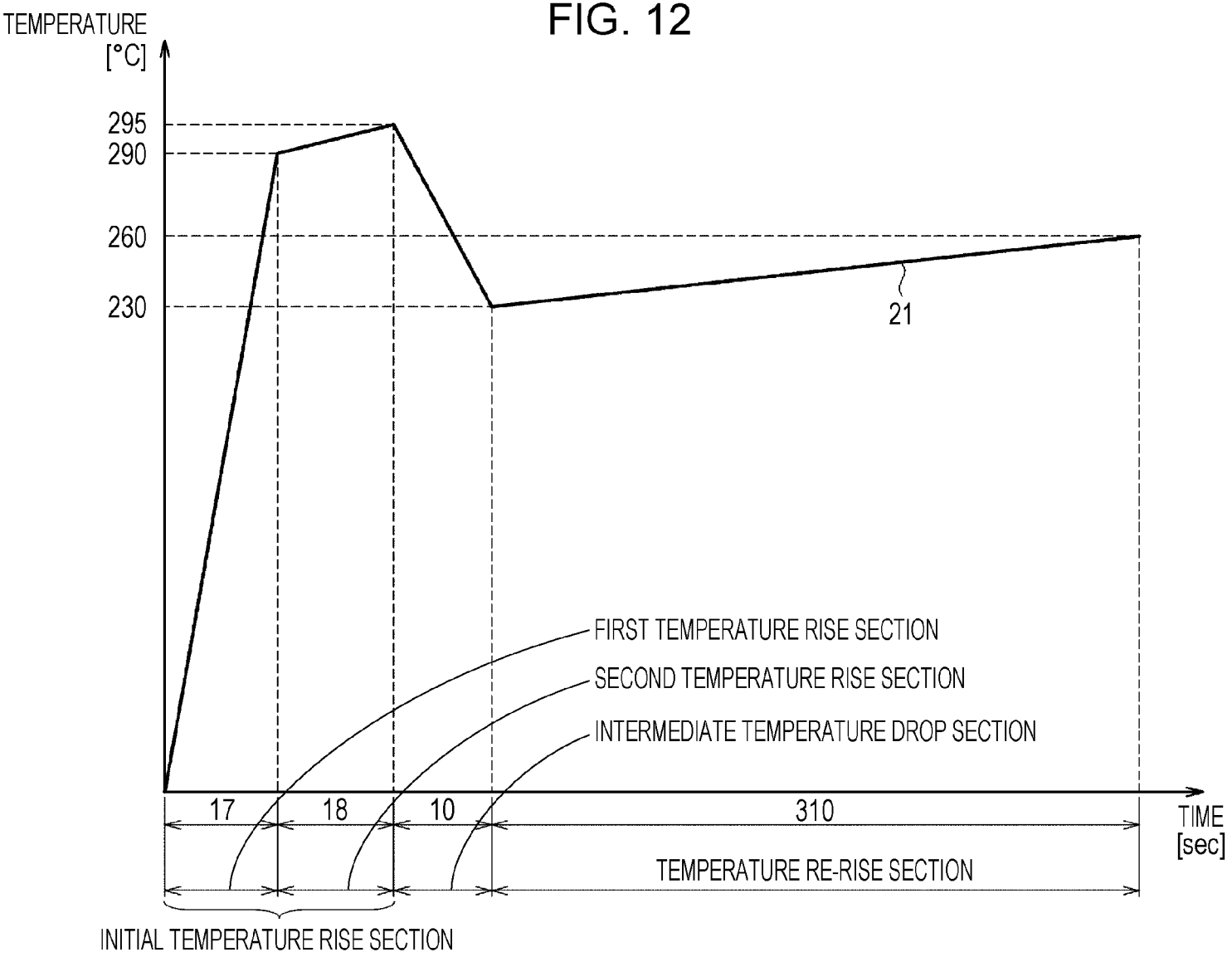
FIG. 12 is a graph illustrating an example of a time-series progression of the real temperature of the heater 40 that operates in accordance with a heating profile presented in Table 2.

FIG. 12 is a graph illustrating an example of a time-series progression of the real temperature of the heater 40 that operates in accordance with the heating profile presented in Table 2. In the graph, the horizontal axis represents time (seconds). In the graph, the vertical axis represents the temperature of the heater 40. In the graph, a line 21 indicates a time-series change in the real temperature of the heater 40.

As presented in Table 2, the initial temperature rise section includes a first temperature rise section and a second temperature rise section subsequent to the first temperature rise section. The first temperature rise section and the second temperature rise section are assigned different target temperatures. Accordingly, as illustrated in FIG. 12, the controller 116 controls the operation of the heater 40 so that 290° C., which is the target temperature, is reached in the first temperature rise section, and then controls the operation of the heater 40 so that 295° C., which is the target temperature, is reached in the second temperature rise section. In this way, temperature control is performed with a target temperature functioning as a milestone in the intermediate portion of the initial temperature rise section. This makes it more likely that in the initial temperature rise section, the real temperature reaches the target temperature for the initial temperature rise section.

The first temperature rise section and the second temperature rise section have different temperature rise widths per unit time. The temperature rise width per unit time in the first temperature rise section has a value obtained by dividing a difference between the target temperature set for the first temperature rise section and the initial value by a time length of the first temperature rise section. When the initial value is 0° C., the temperature rise width per unit time in the first temperature rise section in the example presented in Table 2 is given by (290−0)/17≈17. The temperature rise width per unit time in the second temperature rise section has a value obtained by dividing a difference between the target temperature set for the second temperature rise section and the target temperature set for the first temperature rise section by a time length of the second temperature rise section. The temperature rise width per unit time in the second temperature rise section in the example presented in Table 2 is given by (295−290)/18≈0.3.

Of the plurality of temperature rise sections included in the initial temperature rise section, a later temperature rise section has a smaller temperature rise width per unit time than an earlier temperature rise section. In other words, the second temperature rise section has a smaller temperature rise width per unit time than the first temperature rise section. Accordingly, as illustrated in FIG. 12, the temperature slowly rises as time passes toward the latter half of the initial temperature rise section. Thus, the progression of the real temperature can be controlled to be finer toward the latter half of the initial temperature rise section. As a result, an overshoot can be prevented.

The time length of the first temperature rise section, the target temperature set for the first temperature rise section, the time length of the second temperature rise section, and the target temperature set for the second temperature rise section are set so that the temperature rise width per unit time in the second temperature rise section is smaller than the temperature rise width per unit time in the first temperature rise section. In an example, the length of the second temperature rise section may be longer than the length of the first temperature rise section. In the example presented in Table 2, the length of the second temperature rise section is 18 seconds and is longer than 17 seconds, which is the length of the first temperature rise section. In another example, the temperature rise width in the second temperature rise section may be smaller than the temperature rise width in the first temperature rise section. In the example presented in Table 2, the temperature rise width in the second temperature rise section is 295° C.−290° C.=5° C., and is smaller than 290° C.−0° C.=290° C., which is the temperature rise width in the first temperature rise section when the initial value is set to 0° C. as an example. This configuration allows a time section having a sufficient time length for the temperature rise width to be ensured as the second temperature rise section, and thus makes it possible to more reliably prevent an overshoot.

The initial temperature rise section may further include a temperature maintenance section. An example of the heating profile in this case is presented in Table 3.

TABLE 3

Example of heating profile

| Time section | | Time length | Target temperature |
|---|---|---|---|
| Initial temperature rise section | First temperature rise section | 17 sec | 290° C. |
| | Second temperature rise section | 18 sec | 295° C. |
| | Temperature maintenance section | 10 sec | 295° C. |
| Intermediate temperature drop section | | 10 sec | 230° C. |
| Temperature re-rise section | | 310 sec | 260° C. |

Figure 13:
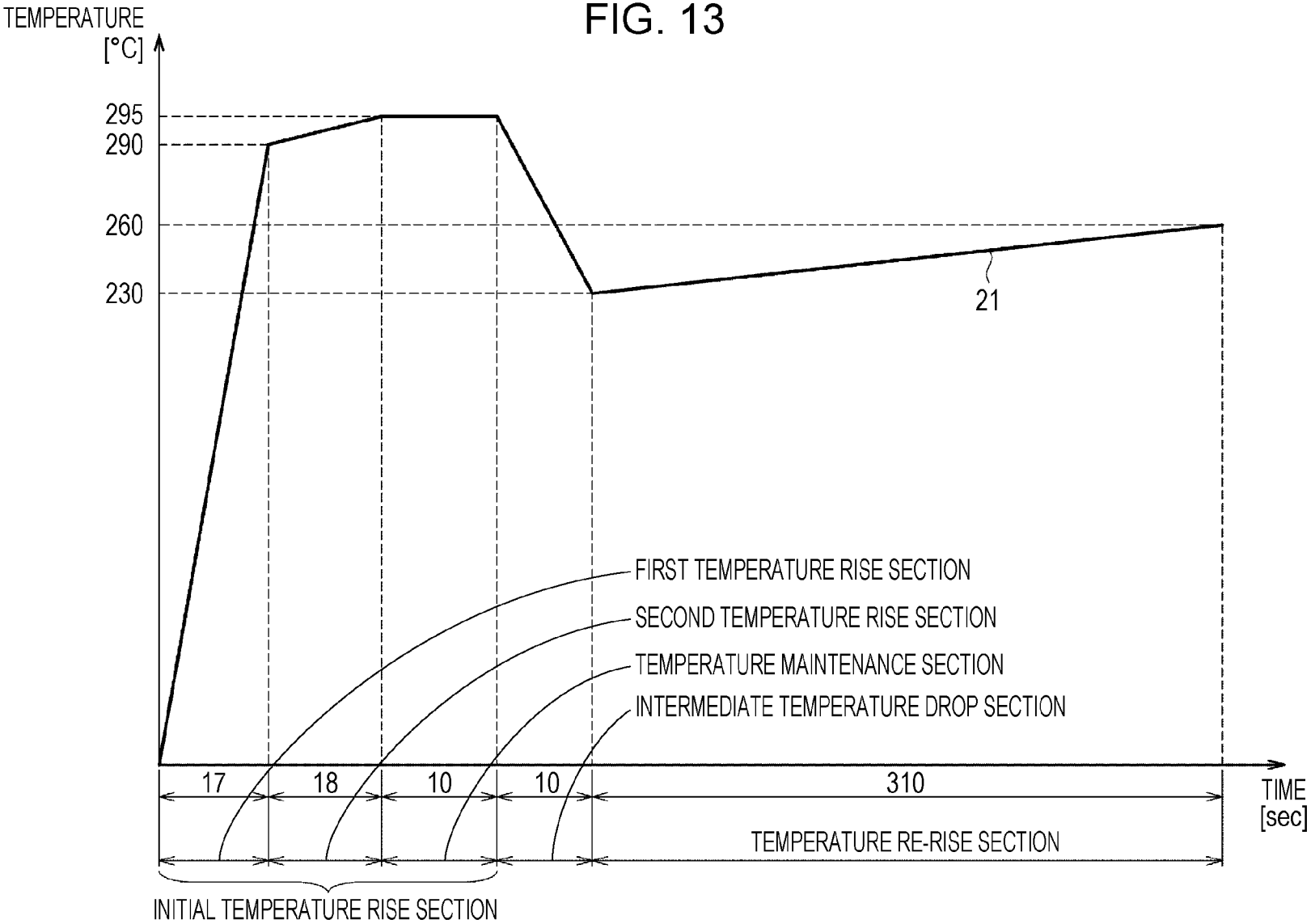
FIG. 13 is a graph illustrating an example of a time-series progression of the real temperature of the heater 40 that operates in accordance with a heating profile presented in Table 3.

FIG. 13 is a graph illustrating an example of a time-series progression of the real temperature of the heater 40 that operates in accordance with the heating profile presented in Table 3. In the graph, the horizontal axis represents time (seconds). In the graph, the vertical axis represents the temperature of the heater 40. In the graph, a line 21 indicates a time-series change in the real temperature of the heater 40.

As presented in Table 3, the initial temperature rise section includes a temperature maintenance section at the end thereof in addition to the first temperature rise section and the second temperature rise section. The target temperature set for the temperature maintenance section is the same as the target temperature set for the time section immediately before the temperature maintenance section. Accordingly, as illustrated in FIG. 13, the controller 116 controls the operation of the heater 40 so that the temperature rises to 290° C. in the first temperature rise section, which is 17 seconds, rises to 295° C. in the subsequent second temperature rise section, which is 18 seconds, and is maintained at 295° C. in the further subsequent temperature maintenance section, which is 10 seconds. This configuration makes it possible to sufficiently raise the temperature of the inside of the stick substrate 150 in the temperature maintenance section. Thus, it is possible to prevent the occurrence of a situation in which a bad taste is delivered to the user in the subsequent intermediate temperature drop section and temperature re-rise section because the temperature of the inside of the stick substrate 150 is not sufficiently raised.

The number of temperature rise sections included in the initial temperature rise section is not limited to two. The initial temperature rise section may include three or more temperature rise sections. In this case, of the plurality of temperature rise sections included in the initial temperature rise section, a later temperature rise section has a smaller temperature rise width per unit time than an earlier temperature rise section.

It is also desirable in this modification that, when compared among the initial temperature rise section, the intermediate temperature drop section, and the temperature re-rise section, the absolute value of the amount of change in target temperature per unit time be smallest in the temperature re-rise section, second smallest in the intermediate temperature drop section, and largest in the initial temperature rise section. In particular, it is desirable that the absolute value of the amount of change in target temperature per unit time be smallest in the temperature re-rise section, second smallest in the intermediate temperature drop section, and largest in the first temperature rise section. It is also desirable that, when the time lengths of the initial temperature rise section, the intermediate temperature drop section, and the temperature re-rise section are compared, the time length of the intermediate temperature drop section be shortest, the time length of the initial temperature rise section be second shortest, and the time length of the temperature re-rise section be longest. In particular, it is desirable that the time length of the intermediate temperature drop section be shortest, the time length of the first temperature rise section be second shortest, and the time length of the temperature re-rise section be longest. With this configuration, the temperature of the heater 40 rapidly rises in the initial temperature rise section, the heater 40 exits a high-temperature state in the early stage in the intermediate temperature drop section, and the temperature of the heater 40 slowly rises in the temperature re-rise section. It is thus possible to terminate preheating in the early stage and to provide a puff experience of sufficient quality to the user over a period from the beginning to the end of the heating profile.

In the foregoing description, the initial temperature rise section includes the temperature maintenance section. However, it may be understood that the temperature maintenance section is included between the initial temperature rise section and the intermediate temperature drop section. In other words, the heating profile may include the initial temperature rise section, the temperature maintenance section, the intermediate temperature drop section, and the temperature re-rise section in sequence. Even in this case, the effects described above can be similarly achieved. The initial temperature rise section may include the temperature maintenance section at the end thereof, and the temperature maintenance section may also be included between the initial temperature rise section and the intermediate temperature drop section.

<3.2. Second Modification>

A rapid temperature rise of the stick substrate 150 causes a rapid consumption of the aerosol source contained in the stick substrate 150, which may inconvenience the user such that the user may be given an excessively strong flavor or the aerosol source may be exhausted early.

Accordingly, a second modification provides a heating profile that includes a stepwise temperature rise section. The stepwise temperature rise section is a time section in which the target temperature rises stepwise. This configuration may prevent a rapid temperature rise of the stick substrate 150 to prevent the inconvenience described above, and makes it possible to improve the quality of the puff experience of the user. An example of the heating profile according to the present modification is presented in Table 4.

TABLE 4

Example of heating profile

| Time section | | Time length | Target temperature |
|---|---|---|---|
| Initial temperature rise section | | 35 sec | 295° C. |
| Intermediate temperature drop section | | 10 sec | 230° C. |
| Temperature re-rise section | Temperature maintenance section | 135 sec | 230° C. |
| | Temperature rise section | 80 sec | 260° C. |
| | Temperature maintenance section | 95 sec | 260° C. |

Figure 14:
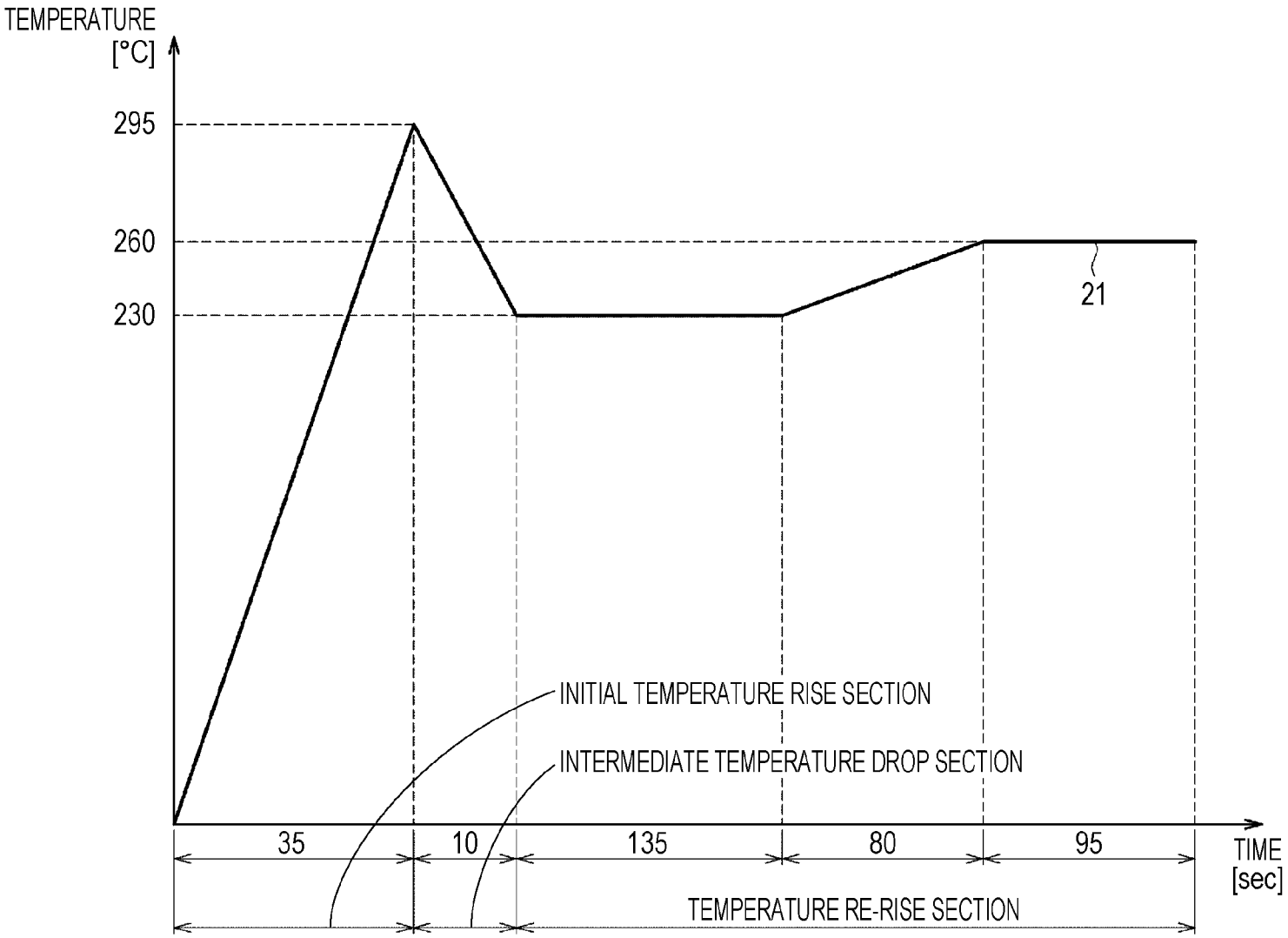
FIG. 14 is a graph illustrating an example of a time-series progression of the real temperature of the heater 40 that operates in accordance with a heating profile presented in Table 4.

FIG. 14 is a graph illustrating an example of a time-series progression of the real temperature of the heater 40 that operates in accordance with the heating profile presented in Table 4. In the graph, the horizontal axis represents time (seconds). In the graph, the vertical axis represents the temperature of the heater 40. In the graph, a line 21 indicates a time-series change in the real temperature of the heater 40.

As presented in Table 4, the heating profile includes a temperature re-rise section as a stepwise temperature rise section. The stepwise temperature rise section includes a plurality of time sections, and the target temperature set for each of the plurality of time sections included in the stepwise temperature rise section is equal to or higher than the target temperature set for the immediately preceding time section. In the example presented in Table 4, the target temperature for the first temperature maintenance section included in the temperature re-rise section is 230° C., which is the same as the target temperature for the intermediate temperature drop section. The target temperature for the temperature rise section included in the temperature re-rise section is 260° C., which is higher than the target temperature for the first temperature maintenance section. The target temperature for the second temperature maintenance section included in the temperature re-rise section is 260° C., which is the same as the target temperature for the temperature re-rise section. Accordingly, as illustrated in FIG. 14, the controller 116 controls the operation of the heater 40 so that in the temperature re-rise section, the temperature is maintained at 230° C. in the first temperature maintenance section, rises to 260° C. in the temperature rise section, and is maintained at 260° C. in the second temperature maintenance section. This configuration allows a slow generation of an aerosol in the temperature re-rise section, and thus makes it is possible to extend the life of the stick substrate 150. In addition, it is possible to extract sufficient flavor from the stick substrate 150 until the end of the temperature re-rise section.

The stepwise temperature rise section may alternately include a temperature maintenance section and a temperature rise section. The target temperature set for the temperature maintenance section is the same as the target temperature set for the time section immediately before the temperature maintenance section. The target temperature set for the temperature rise section is higher than the target temperature set for the time section immediately before the temperature rise section. In the example presented in Table 4, the temperature re-rise section includes a temperature maintenance section of 135 seconds at the beginning thereof, followed by a temperature rise section of 80 seconds, and a temperature maintenance section of 95 seconds at the end thereof. Since the target temperature set for the temperature maintenance section is the same as the target temperature set for the immediately preceding time section, even if the real temperature does not reach the target temperature in the immediately preceding time section, the real temperature can be brought close to the target temperature in the temperature maintenance section. Accordingly, it is possible to improve the followability of the real temperature with respect to the target temperature throughout the entire stepwise temperature rise section.

The number of temperature rise sections included in the stepwise temperature rise section is not limited to one, and the stepwise temperature rise section may include a plurality of temperature rise sections. An example of the heating profile in this case is presented in Table 5.

TABLE 5

Example of heating profile

| Time section | | Time length | Target temperature |
|---|---|---|---|
| Initial temperature rise section | | 35 sec | 295° C. |
| Intermediate temperature drop section | | 10 sec | 230° C. |
| Temperature re-rise section | Temperature maintenance section | 20 sec | 230° C. |
| | Temperature rise section | 5 sec | 234° C. |
| | Temperature maintenance section | 20 sec | 234° C. |
| | Temperature rise section | 5 sec | 238° C. |

TABLE 5-continued

| Example of heating profile | | |
|---|---|---|
| Time section | Time length | Target temperature |
| Temperature maintenance section | 20 sec | 238° C. |
| Temperature rise section | 5 sec | 242° C. |
| Temperature maintenance section | 20 sec | 242° C. |
| Temperature rise section | 5 sec | 246° C. |
| Temperature maintenance section | 20 sec | 246° C. |
| Temperature rise section | 5 sec | 250° C. |
| Temperature maintenance section | 20 sec | 250° C. |
| Temperature rise section | 5 sec | 254° C. |
| Temperature maintenance section | 20 sec | 254° C. |
| Temperature rise section | 5 sec | 260° C. |
| Temperature maintenance section | 135 sec | 260° C. |

Figure 15:
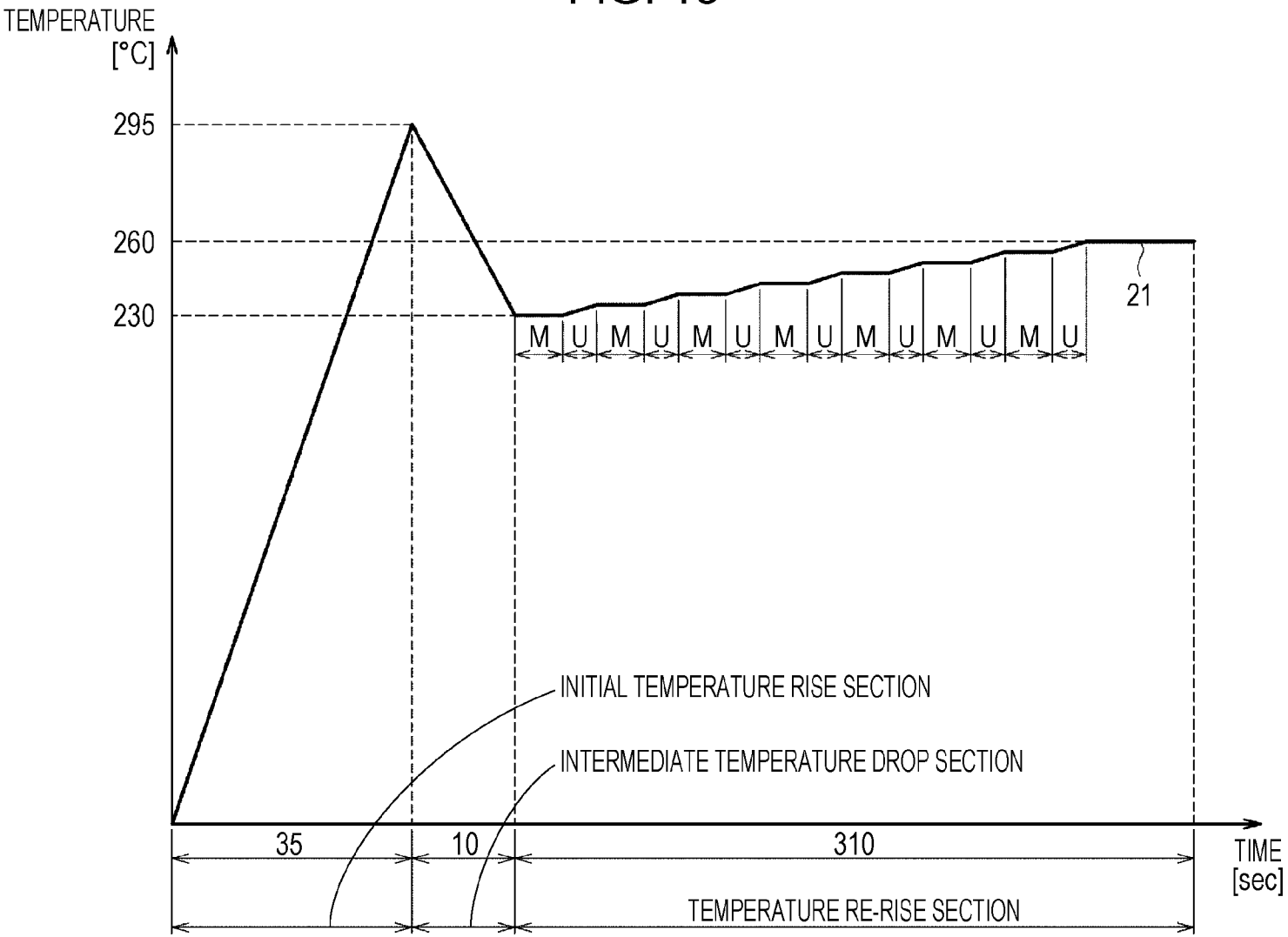
FIG. 15 is a graph illustrating an example of a time-series progression of the real temperature of the heater 40 that operates in accordance with a heating profile presented in Table 5.

FIG. 15 is a graph illustrating an example of a time-series progression of the real temperature of the heater 40 that operates in accordance with the heating profile presented in Table 5. In the graph, the horizontal axis represents time (seconds). In the graph, the vertical axis represents the temperature of the heater 40. In the graph, a line 21 indicates a time-series change in the real temperature of the heater 40. In FIG. 15, temperature maintenance sections in the temperature re-rise section are labeled "M", and temperature rise sections in the temperature re-rise section are labeled "U".

The heating profile presented in Table 15 includes a temperature re-rise section as a stepwise temperature rise section. The temperature re-rise section alternately includes a plurality of temperature maintenance sections M and a plurality of temperature rise sections U. Accordingly, as illustrated in FIG. 15, the controller 116 causes the temperature of the heater 40 to gradually rise in a plurality of steps in the temperature re-rise section. At the completion of a temperature rise with a predetermined temperature rise width in each of the temperature rise sections U, the controller 116 causes the subsequent temperature maintenance section M to start. It is desirable that the predetermined temperature rise width in each of the temperature rise sections U be kept low about several degrees C. to several dozen of degrees C. It is also desirable that the target temperature set for each of the temperature rise sections U be raised in a range not exceeding 260° C., which is the target temperature for the temperature re-rise section. This configuration can prevent the life of the stick substrate 150 from being shortened more than necessary. The temperature rise sections U may have the same temperature rise width over the entire temperature re-rise section, or may have different temperature rise width such that, for example, a later temperature rise section U has a smaller temperature rise width.

Upon detection of the user having performed an action of inhaling an aerosol, the controller 116 may cause the next temperature rise section U to start. In other words, in the temperature re-rise section, a temperature rise may occur each time the user takes a puff, and the temperature may be maintained in a period between puffs. This configuration allows a temperature rise to occur at a timing when the user takes a puff, and increases the amount of extracted flavor. The increase in the amount of extracted flavor allows the user to taste flavor whose quality is maintained even in the latter half of the heating profile. As a result, the user's feeling of satisfaction with the puff action can be improved.

Alternatively, in accordance with the elapsed time in a temperature maintenance section M, the controller 116 may cause the temperature maintenance section M to end and the subsequent temperature rise section U to start. For example, in the temperature re-rise section, the temperature may be raised after the temperature is maintained for a predetermined amount of time. This configuration allows a temperature rise without detection of the puff action of the user, and thus makes it possible to reduce the processing load on the controller 116. The predetermined amount of time is desirably set to a length equal to an interval between previous puffs taken by the user. In this case, effects similar to the effects described above for a temperature rise that occurs each time the user takes a puff is achieved.

It is also desirable in this modification that, when compared among the initial temperature rise section, the intermediate temperature drop section, and the temperature re-rise section, the absolute value of the amount of change in target temperature per unit time be smallest in the temperature re-rise section (more specifically, the average value be smallest in the temperature re-rise section), second smallest in the intermediate temperature drop section, and largest in the initial temperature rise section. It is also desirable that, when the time lengths of the initial temperature rise section, the intermediate temperature drop section, and the temperature re-rise section are compared, the time length of the intermediate temperature drop section be shortest, the time length of the initial temperature rise section be second shortest, and the time length of the temperature re-rise section be longest. With this configuration, the temperature of the heater 40 rapidly rises in the initial temperature rise section, the heater 40 exits a high-temperature state in the early stage in the intermediate temperature drop section, and the temperature of the heater 40 slowly rises in the temperature re-rise section. It is thus possible to terminate preheating in the early stage and to provide a puff experience of sufficient quality to the user over a period from the beginning to the end of the heating profile.

<3.3. Third Modification>

The interval between puffs taken differs from user to user. For this reason, a uniform heating profile may make it difficult for some users to obtain sufficient flavor. For example, in the embodiment described above, a user who takes puffs at short intervals may not be able to feel the effect of improvement in flavor by a temperature re-rise because the life of the stick substrate 150 may end before a sufficient temperature rise is achieved in the temperature re-rise section.

Accordingly, a third modification provides a heating profile that is variable in response to an input from a user. With this configuration, an aerosol can be generated in accordance with a heating profile suitable for the user. Thus, any user can receive sufficient puff experience.

In the present modification, the heating profile includes a plurality of slots. The slots are time sections that are continuous along the time axis. The controller 116 controls the operation of the heater 40 in accordance with a slot (hereinafter also referred to as a current slot) corresponding to an elapsed time from the start of the control of the operation of the heater 40 based on the heating profile.

Each slot is assigned a target temperature such that a target temperature at the end of the slot is set for the slot. Controlling the operation of the heater 40 in accordance with a slot corresponds to controlling supply of electric power to the heater 40 so that the real temperature reaches the target temperature set for the slot at the end of the slot. In response to switching a slot to another slot, the controller 116 controls the operation of the heater 40 in accordance with the target temperature set for the other slot.

Each slot is assigned a plurality of switching conditions. The controller 116 switches a slot for which any one of the plurality of switching conditions is satisfied to another slot, and controls the operation of the heater 40 in accordance with the other slot. In a case where any one of the plurality of switching conditions set for the current slot is satisfied, the controller 116 switches to the slot subsequent to the current slot. This configuration allows flexible control based on a plurality of switching conditions.

The plurality of switching conditions set for each slot include a condition that an amount of time corresponding to the time length of the slot has elapsed. In other words, at a lapse of time corresponding to the time length of the current slot after the occurrence of switching to the current slot, the controller 116 switches from the current slot to the subsequent slot.

The plurality of switching conditions set for each slot include detection of the user's action of inhaling an aerosol. In other words, the controller 116 switches to the subsequent slot upon detection of the user's action of inhaling an aerosol. In this case, the control based on the current slot is interrupted and the slot is switched to the subsequent slot. Accordingly, upon detection of the user's action of inhaling an aerosol, the controller 116 reduces the time length of the heating profile. The time length of the heating profile is the length of a period in which the operation of the heater 40 is controlled in accordance with the heating profile. At this time, the controller 116 reduces the time length of the heating profile by an amount corresponding to the time length of the remaining period from a timing when the user's action of inhaling an aerosol is detected to the end of the slot corresponding to the timing. For example, the current slot has a time length of 20 seconds, and a puff action is detected at a timing when a period of 5 seconds has elapsed since the occurrence of switching to the current slot. In this case, the controller 116 reduces the time length of the heating profile by an amount corresponding to 20−5=15 seconds. This configuration reduces the time length of the heating profile as the interval of the puff action decreases. Accordingly, it is possible to prevent a situation in which even if the puff action is performed a large number of times and the aerosol source is exhausted in the early stage, heating based on the heating profile is continued and a bad flavor is delivered to the user.

An example of an extracted portion of the heating profile including four consecutive slots is presented in Table 6.

TABLE 6

Example of heating profile

| Time section | Time length | Target temperature |
|---|---|---|
| Slot S1 | 20 sec | 235° C. |
| Slot S2 | 20 sec | 240° C. |
| Slot S3 | 20 sec | 240° C. |
| Slot S4 | 20 sec | 245° C. |

Figure 16:
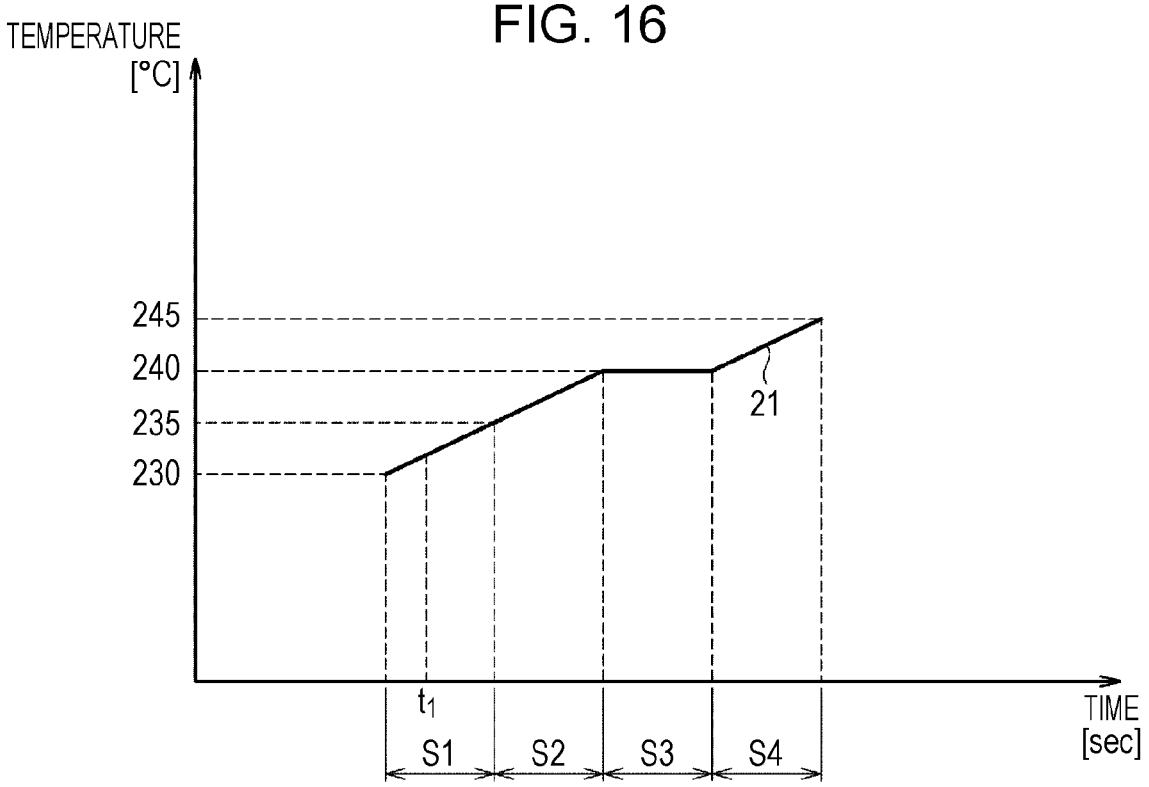
FIG. 16 is a graph illustrating an example of a time-series progression of the real temperature of the heater 40 that operates in accordance with a heating profile presented in Table 6.
Figure 17:
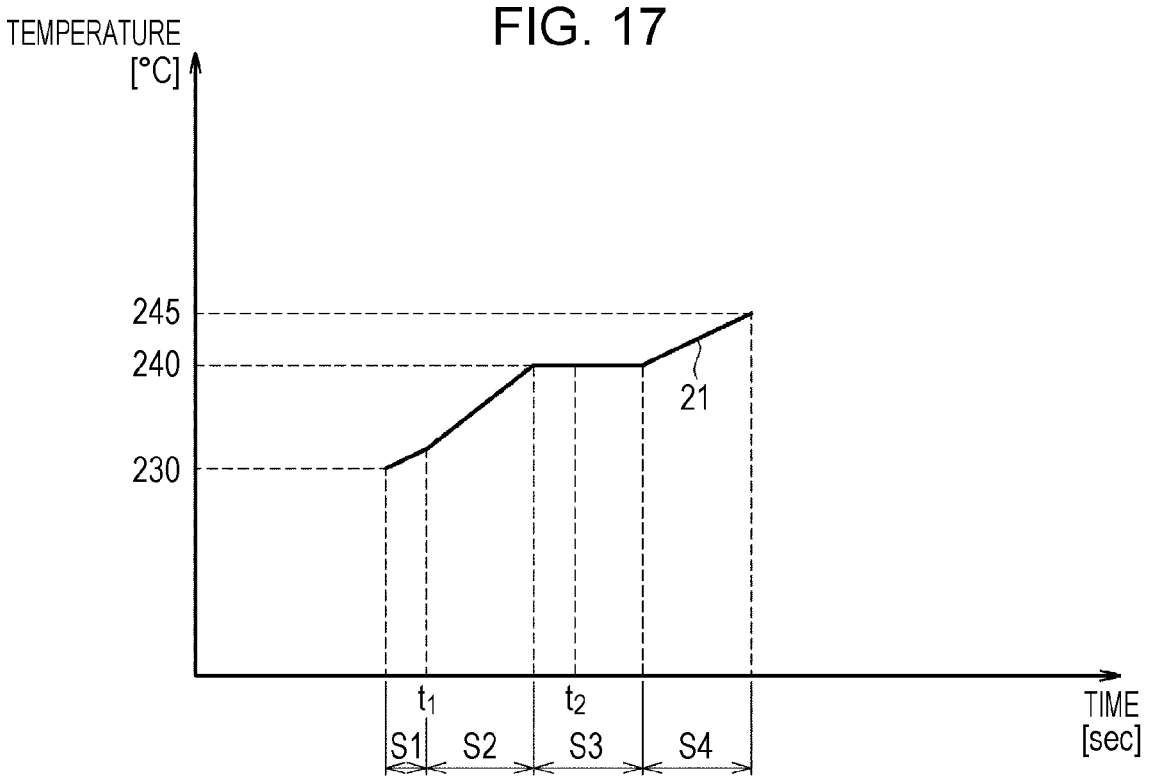
FIG. 17 is a graph illustrating an example of a time-series progression of the real temperature of the heater 40 that operates in accordance with the heating profile presented in Table 6.
Figure 18:
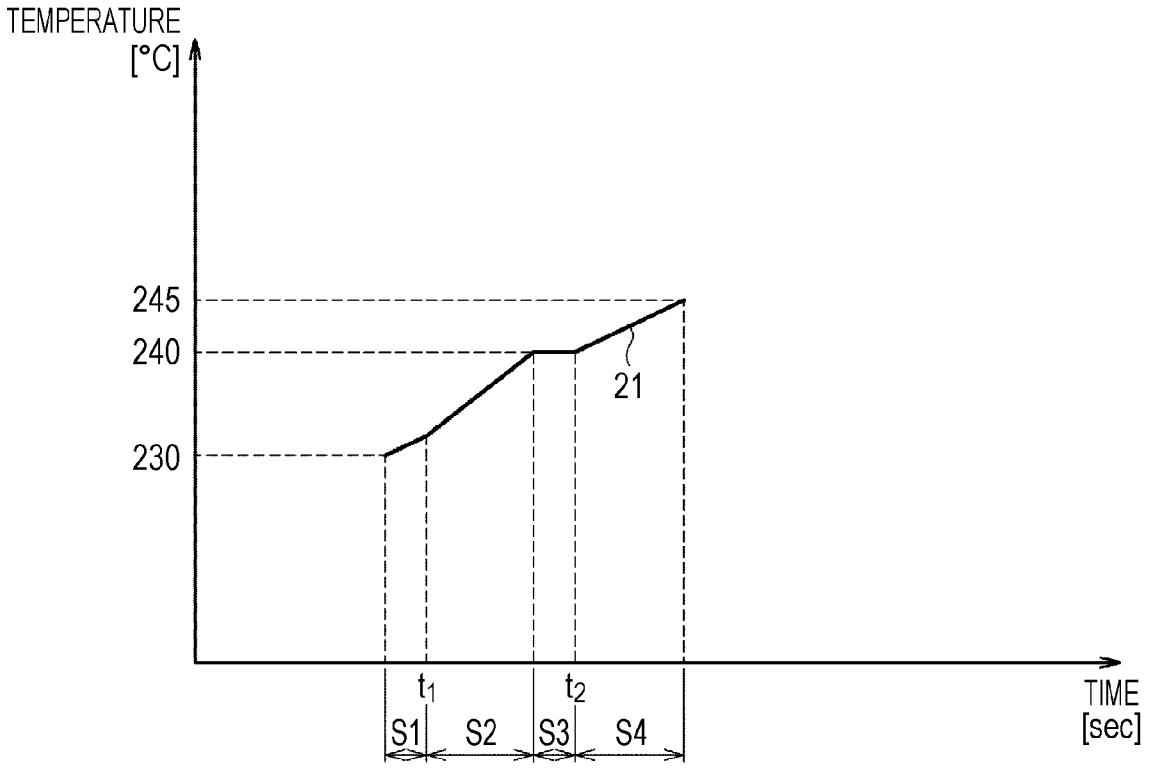
FIG. 18 is a graph illustrating an example of a time-series progression of the real temperature of the heater 40 that operates in accordance with the heating profile presented in Table 6.

FIG. 16 to FIG. 18 are graphs illustrating examples of a time-series progression of the real temperature of the heater 40 that operates in accordance with the heating profile presented in Table 6. In the graphs, the horizontal axis represents time (seconds). In the graphs, the vertical axis represents the temperature of the heater 40. In the graphs, a line 21 indicates a time-series change in the real temperature of the heater 40.

In particular, FIG. 16 illustrates a time-series progression of the real temperature of the heater 40 in a case where no puff action made by the user is detected in each of the slots S1 to S4. If no puff action made by the user is detected, each of the slots S1 to S4 is switched to the subsequent slot at a lapse of time corresponding to the time length of the slot. It is assumed that before the slot S1, another slot having a target temperature of 230° C. is continuous with the slot S1. Accordingly, as illustrated in FIG. 16, the temperature is raised from 230° C. to 235° C. in the slot S1. Likewise, the temperature is raised to 240° C. in the slot S2, maintained at 240° C. in the slot S3, and raised to 245° C. in the slot S4.

Here, it is assumed that a predetermined input is detected at time $t_1$ included in the slot S1. FIG. 17 illustrates a time-series progression of the real temperature of the heater 40 in a case where a puff action made by the user is detected at the time $t_1$ included in the slot S1. If a puff action made by the user is detected at the time $t_1$ included in the slot S1, the controller 116 causes the slot S1 to end at the time $t_1$ and switches to the slot S2. Accordingly, as illustrated in FIG. 17, the controller 116 controls the operation of the heater 40 so that the real temperature of the heater 40 reaches the target temperature, namely, 240° C., at the end of the slot S2 after switching. Further, as illustrated in FIG. 17, since the slot S1 is interrupted midway, the time length of the heating profile is reduced accordingly.

Further, it is assumed that a predetermined input is detected at time $t_2$ included in the slot S3. FIG. 18 illustrates a time-series progression of the real temperature of the heater 40 in a case where a puff action made by the user is detected at the time $t_1$ included in the slot S1 and the time $t_2$ included in the slot S3. If a puff action made by the user is detected at the time $t_2$ included in the slot S3, the controller 116 causes the slot S3 to end at the time $t_2$ and switches to the slot S4. Accordingly, as illustrated in FIG. 18, the controller 116 controls the operation of the heater 40 so that the real temperature of the heater 40 reaches the target temperature, namely, 240° C., at the end of the slot S4 after switching. Further, as illustrated in FIG. 18, since the slot S3 is interrupted midway, the time length of the heating profile is reduced accordingly.

As described above, in the present modification, it is possible to perform the temperature control of the heater 40 while switching the slot in response to any one of the plurality of switching conditions set for the slot being satisfied. In this modification, in particular, it is possible to perform the temperature control of the heater 40 while switching the slot in response to detection of a puff action made by the user. This configuration makes it possible to perform fine temperature control in accordance with the interval between puffs taken by the user.

At least some of the plurality of slots included in the heating profile may have different target temperatures between two consecutive slots. For example, in the example presented in Table 6, the slot S1 has a target temperature of 235° C., and the slot S2 has a target temperature of 240° C., which is different from 235° C. This configuration allows a continuous temperature rise of the heater 40 each time the user takes a puff, and thus makes it possible to improve the flavor that the user tastes.

At least some of the plurality of slots included in the heating profile may have the same target temperature between two consecutive slots. For example, in the example presented in Table 6, the slot S2 has a target temperature of 240° C., and the slot S3 also has a target temperature of 240° C. This configuration can maintain the temperature of the heater 40 even when the user takes a puff, and thus makes it possible to extend the life of the stick substrate 150.

Target temperatures are desirably set such that the target temperature set for a slot is equal to or higher than the target temperature set for another slot that is before the slot and that is continuous with the slot. In other words, the target temperature set for one of the continuous slots is not set to a smaller value than the target temperature set for the preceding slot, and is set to the same value as or a larger value than the target temperature set for the preceding slot. This configuration can maintain or raise the temperature each time the user takes a puff, and thus makes it possible to maintain or improve the flavor that the user tastes.

The number of slots is desirably two or more. Too small a number of slots may cause difficulty in fine temperature control, resulting in deterioration of the flavor that the user tastes. By contrast, the configuration described above can prevent too small a number of slots, and thus makes it possible to prevent deterioration of the flavor that the user tastes.

The number of slots is desirably 15 or less. Too large a number of slots may cause frequent switching of slots, resulting in an increase in the processing load on the controller 116. By contrast, the configuration described above can prevent too large a number of slots, and thus makes it possible to reduce the processing load on the controller 116.

The time length of each slot is desirably 10 seconds or more. Too short a time length of each slot may cause frequent switching of slots, resulting in an increase in the processing load on the controller 116. By contrast, the configuration described above can prevent too short a time length of each slot, and thus makes it possible to reduce the processing load on the controller 116.

The time length of each slot is desirably less than 25 seconds. Too long a time length of each slot may cause difficulty in fine temperature control, resulting in deterioration of the flavor that the user tastes. By contrast, the configuration described above can prevent too long a time length of each slot, and thus makes it possible to prevent deterioration of the flavor that the user tastes.

At least two of the plurality of slots included in the heating profile may have different time lengths. This configuration allows fine temperature control.

At least two of the plurality of slots included in the heating profile may have the same time length. This configuration allows simple switching of slots, and thus makes it possible to reduce the processing load on the controller 116.

The slots are typically set in the temperature re-rise section. In this case, the temperature re-rise section is compressed each time a puff is taken, and a temperature rise occurs at an earlier timing than in a case where no puff is taken. Accordingly, even in a case where the user takes puffs at short intervals, the temperature can sufficiently be raised in the temperature re-rise section, and thus it is possible for the user to feel the effect of improvement in flavor by a temperature re-rise. As described above, the present modification can provide a sufficient puff experience to a user of any puff style.

It is also desirable in this modification that, when compared among the initial temperature rise section, the intermediate temperature drop section, and the temperature re-rise section, the absolute value of the amount of change in target temperature per unit time be smallest in the temperature re-rise section (more specifically, the average value be smallest in the temperature re-rise section), second smallest in the intermediate temperature drop section, and largest in the initial temperature rise section. It is also desirable that, when the time lengths of the initial temperature rise section, the intermediate temperature drop section, and the temperature re-rise section are compared, the time length of the intermediate temperature drop section be shortest, the time length of the initial temperature rise section be second shortest, and the time length of the temperature re-rise section be longest. With this configuration, the temperature of the heater 40 rapidly rises in the initial temperature rise section, the heater 40 exits a high-temperature state in the early stage in the intermediate temperature drop section, and the temperature of the heater 40 slowly rises in the temperature re-rise section. It is thus possible to terminate preheating in the early stage and to provide a puff experience of sufficient quality to the user over a period from the beginning to the end of the heating profile.

<<4. Supplementary Note>>

While a preferred embodiment of the present invention has been described in detail with reference to the accompanying drawings, the present invention is not limited to this example. It will be apparent that those skilled in the art to which the present invention belongs can achieve various modifications or variations without departing from the scope of the technical concept presented in the claims, and it is understood that such modifications or variations also fall within the technical scope of the present invention.

In the embodiment described above, an example has been described in which the end of the intermediate temperature drop section is determined in accordance with the elapsed time from the beginning of the intermediate temperature drop section. However, the present invention is not limited to this example. The controller 116 may determine the end of the intermediate temperature drop section in accordance with the difference between the target temperature set for the intermediate temperature drop section and the actual temperature of the heater 40. For example, the controller 116 monitors the real temperature of the heater 40 while performing measurement by using a temperature sensor installed near the heater 40 in a predetermined cycle. When the measured real temperature reaches the target temperature for the intermediate temperature drop section, the controller 116 determines that switching from the intermediate temperature drop section to the temperature re-rise section is to be performed. This configuration makes it possible to perform switching from the intermediate temperature drop section to the temperature re-rise section at an appropriate timing regardless of the external environment such as the outside air temperature.

In the embodiment described above, the controller 116 controls the operation of the heater 40 in accordance with the deviation of the real temperature from the target temperature. In an example, the controller 116 may control the operation of the heater 40 in accordance with the deviation of the current real temperature from the target temperature set for the current time section (that is, the time section corresponding to the elapsed time from the start of the control of the operation of the heater 40 based on the heating profile). In other words, in the example presented in Table 1 and illustrated in FIG. 10, in a case where the real temperature of the heater 40 after 10 seconds from the start of heating is 100° C., the controller 116 may control the operation of the heater 40 in accordance with the deviation of 100° C. from 295° C., namely, 195° C. In another example, the controller 116 may control the operation of the heater 40 in accordance with the deviation of the current real temperature from the current target temperature. That is, in the example presented in Table 1 and illustrated in FIG. 10, in a case where the real temperature of the heater 40 after 10 seconds from the start of heating is 100° C., the current target temperature is approximately 295÷ 35×10=84° C. Accordingly, the controller 116 may control the operation of the heater 40 in accordance with the deviation of 100° C. from 84° C., namely, −16° C.

The operation of the heater 40 for a temperature rise, which is performed when the current real temperature is lower than the target temperature set for the current time section, may be implemented in various ways. In an example, the operation of the heater 40 for a temperature rise may be controlled in accordance with the remaining time until the end of the time section and the deviation of the real temperature from the target temperature. In other words, in the example presented in Table 1 and illustrated in FIG. 10, in a case where the real temperature of the heater 40 after 10 seconds from the start of heating is 100° C., the controller 116 may adjust the duty ratio of electric power pulses to be supplied to the heater 40 so that the temperature can rise by another 195° C. after 25 seconds. In another example, the operation of the heater 40 for a temperature rise may be fixed. In other words, the controller 116 may always maximize the duty ratio of electric power pulses to be supplied to the heater 40, for example, at the time of a temperature rise.

The notification of the timing of the start of the puffable period may be provided at any timing. In an example, the notification of the timing of the start of the puffable period may be provided at the end of the initial temperature rise section. In another example, in a case where the initial temperature rise section includes a temperature maintenance section at the end thereof, the notification of the timing of the start of the puffable period may be provided at the beginning of the temperature maintenance section included in the initial temperature rise section. In another example, when a temperature maintenance section is included between the initial temperature rise section and the intermediate temperature drop section, the notification of the timing of the start of the puffable period may be provided at the end of the temperature maintenance section.

For example, in the embodiment described above, an example has been described in which the gap between the heater assembly 30 and the stick substrate 150 functions as a flow path for introducing air into the stick substrate 150. However, the present invention is not limited to this example. For example, a bottom wall of the heater assembly 30 may have an opening that communicates with the outside air. When the user takes a puff, air may be introduced into the stick substrate 150 through the opening.

For example, the modifications described above may be combined as appropriate. That is, at least two of the first modification, the second modification, and the third modification may be combined. In an example, the first modification and the second modification may be combined. In other words, the heating profile may include an initial temperature rise section including a plurality of temperature rise sections having different temperature rise widths per unit time, an intermediate temperature drop section, and a temperature re-rise section in which the target temperature rises stepwise. In another example, the first modification and the third modification may be combined. In this case, the heating profile may include an initial temperature rise section including a plurality of temperature rise sections having different temperature rise widths per unit time, an intermediate temperature drop section, and a temperature re-rise section including a plurality of slots.

A series of processes performed by each of the devices described herein may be implemented using any one of software, hardware, and a combination of software and hardware. A program constituting the software is stored in advance in, for example, an internal or external recording medium (non-transitory medium) of each device. For example, each program is read into a RAM at the time of execution by a computer and executed by a processor such as a CPU. Examples of the recording medium include a magnetic disk, an optical disk, a magneto-optical disk, and a flash memory. Further, the computer program described above may be distributed via, for example, a network without using a recording medium.

The processes described herein using the flowchart and the sequence diagram may not necessarily be executed in the illustrated order. Some processing steps may be executed in parallel. Any additional processing step may be used, or some processing steps may be omitted.

The following configurations also fall within the technical scope of the present invention.

(1)

An inhaler device including:

a heater configured to heat a substrate to generate an aerosol; and a controller configured to control an operation of the heater in accordance with a heating profile that defines a time-series progression of a target temperature, the target temperature being a target value of a temperature of the heater, wherein the heating profile includes a plurality of time sections that are continuous along a time axis, each of the plurality of time sections is assigned the target temperature such that a target temperature at an end of the time section is set for the time section, the heating profile includes an intermediate temperature drop section in an intermediate portion thereof, the target temperature set for the intermediate temperature drop section is lower than the target temperature set for a time section immediately before the intermediate temperature drop section, and the controller is configured to perform control such that no electric power is supplied to the heater in the intermediate temperature drop section.

(2)

The inhaler device according to (1) above, wherein the controller is configured to control the operation of the heater in accordance with an actual temperature of the heater and the target temperature set for the intermediate temperature drop section at a beginning of a time section subsequent to the intermediate temperature drop section.

(3)

The inhaler device according to (2) above, wherein the controller is configured to supply electric power to the heater at a first duty ratio at the beginning of the time section subsequent to the intermediate temperature drop section in a case where the actual temperature of the heater is less than the target temperature set for the intermediate temperature drop section, and supply electric power to the heater at a second duty ratio at the beginning of the time section subsequent to the intermediate temperature drop section in a case where the actual temperature of the heater is equal to or higher than the target temperature set for the intermediate temperature drop section, and the first duty ratio is larger than the second duty ratio.

(4)

The inhaler device according to any one of (1) to (3) above, wherein the controller is configured to determine an end of the intermediate temperature drop section in accordance with an elapsed time from a beginning of the intermediate temperature drop section.

(5)

The inhaler device according to any one of (1) to (3) above, wherein the controller is configured to determine an end of the intermediate temperature drop section in accordance with a difference between the target temperature set for the intermediate temperature drop section and an actual temperature of the heater.

(6)

The inhaler device according to any one of (1) to (5) above, wherein the heating profile includes an initial temperature rise section at a beginning thereof, and the target temperature set for the initial temperature rise section is higher than an initial value.

(7)

The inhaler device according to (6) above, wherein the initial temperature rise section includes a first temperature rise section and a second temperature rise section subsequent to the first temperature rise section, the first temperature rise section and the second temperature rise section have different temperature rise widths per unit time, the temperature rise width per unit time in the first temperature rise section has a value obtained by dividing a difference between the target temperature set for the first temperature rise section and the initial value by a time length of the first temperature rise section, and the temperature rise width per unit time in the second temperature rise section has a value obtained by dividing a difference between the target temperature set for the second temperature rise section and the target temperature set for the first temperature rise section by a time length of the second temperature rise section.

(8)

The inhaler device according to (7) above, wherein the temperature rise width per unit time in the second temperature rise section is smaller than the temperature rise width per unit time in the first temperature rise section.

(9)

The inhaler device according to any one of (6) to (8) above, wherein the initial temperature rise section includes a temperature maintenance section at an end thereof, and the target temperature set for the temperature maintenance section is the same as the target temperature set for a time section immediately before the temperature maintenance section.

(10)

The inhaler device according to any one of (1) to (9) above, wherein the heating profile includes a temperature re-rise section after the intermediate temperature drop section, and the target temperature set for the temperature re-rise section is higher than the target temperature set for a time section immediately before the temperature re-rise section.

(11)

The inhaler device according to (10) above, wherein the temperature re-rise section alternately includes a temperature maintenance section and a temperature rise section, the target temperature set for the temperature maintenance section is the same as the target temperature set for a time section immediately before the temperature maintenance section, and the target temperature set for the temperature rise section is higher than the target temperature set for a time section immediately before the temperature rise section.

(12)

The inhaler device according to (10) or (11) above as dependent on (6) above, wherein the heating profile includes the initial temperature rise section, the intermediate temperature drop section, and the temperature re-rise section in sequence.

(13)

The inhaler device according to (10) or (11) above as dependent on (6) above, wherein the heating profile includes the initial temperature rise section, a temperature maintenance section, the intermediate temperature drop section, and the temperature re-rise section in sequence, and the target temperature set for the temperature maintenance section is the same as the target temperature set for a time section immediately before the temperature maintenance section.

(14)

The inhaler device according to (12) or (13) above, wherein when compared among the initial temperature rise section, the intermediate temperature drop section, and the temperature re-rise section, an absolute value of an amount of change in the target temperature per unit time is smallest in the temperature re-rise section, second smallest in the intermediate temperature drop section, and largest in the initial temperature rise section, the absolute value of the amount of change in the target temperature per unit time in the initial temperature rise section is a value obtained by dividing an absolute value of a difference between the target temperature set for the initial temperature rise section and the initial value by a time length of the initial temperature rise section, the absolute value of the amount of change in the target temperature per unit time in the intermediate temperature drop section is a value obtained by dividing an absolute value of a difference between the target temperature set for the intermediate temperature drop section and the target temperature set for the time section immediately before the intermediate temperature drop section by a time length of the intermediate temperature drop section, and the absolute value of the amount of change in the target temperature per unit time in the temperature re-rise section is a value obtained by dividing an absolute value of a difference between the target temperature set for the temperature re-rise section and the target temperature set for the time section immediately before the temperature re-rise section by a time length of the temperature re-rise section.

(15)

The inhaler device according to any one of (12) to (14) above, wherein when a time length of the initial temperature rise section, a time length of the intermediate temperature drop section, and a time length of the temperature re-rise section are compared, the time length of the intermediate temperature drop section is shortest, the time length of the initial temperature rise section is second shortest, and the time length of the temperature re-rise section is longest.

(16)

The inhaler device according to any one of (1) to (15) above, further including a chamber configured to receive the substrate, wherein the chamber includes an opening into which the substrate is to be inserted, and a holder configured to hold the substrate, and the holder includes a pressing portion configured to press a portion of the substrate, and a non-pressing portion, and the heater is disposed on an outer surface of the pressing portion.

(17)

The inhaler device according to (16) above, wherein the heater is disposed on an outer surface of the pressing portion.

(18)

The inhaler device according to any one of (1) to (17) above, wherein the heating profile includes a plurality of slots, the plurality of slots being time sections that are continuous along a time axis, each of the slots is assigned a plurality of switching conditions, and the controller is configured to switch a slot for which any one of the plurality of switching conditions is satisfied among the slots to another slot among the slots and control the operation of the heater in accordance with the other slot.

(19)

The inhaler device according to any one of (1) to (18) above, wherein the controller is configured to control the operation of the heater in accordance with a deviation of an actual temperature of the heater from the target temperature corresponding to an elapsed time from a start of control of the operation of the heater based on the heating profile.

(20)

A control method for controlling an inhaler device including a heater configured to heat a substrate to generate an aerosol, the control method including:

controlling an operation of the heater in accordance with a heating profile that defines a time-series progression of a target temperature, the target temperature being a target value of a temperature of the heater, wherein the heating profile includes a plurality of time sections that are continuous along a time axis, each of the plurality of time sections is assigned the target temperature such that a target temperature at an end of the time section is set for the time section, the heating profile includes an intermediate temperature drop section in an intermediate portion thereof, the target temperature set for the intermediate temperature drop section is lower than the target temperature set for a time section immediately before the intermediate temperature drop section, and the controlling of an operation of the heater includes performing control such that no electric power is supplied to the heater in the intermediate temperature drop section.

(21)

A non-transitory computer readable medium having a program stored therein, the program for causing a computer for controlling an inhaler device including a heater configured to heat a substrate to generate an aerosol, to execute:

controlling an operation of the heater in accordance with a heating profile that defines a time-series progression of a target temperature, the target temperature being a target value of a temperature of the heater, wherein the heating profile includes a plurality of time sections that are continuous along a time axis, each of the plurality of time sections is assigned the target temperature such that a target temperature at an end of the time section is set for the time section, the heating profile includes an intermediate temperature drop section in an intermediate portion thereof, the target temperature set for the intermediate temperature drop section is lower than the target temperature set for a time section immediately before the intermediate temperature drop section, and the controlling of an operation of the heater includes performing control such that no electric power is supplied to the heater in the intermediate temperature drop section.

REFERENCE SIGNS LIST

100 inhaler device
111 power supply
112 sensor
113 notifier
114 memory
115 communicator
116 controller
150 stick substrate
151 substrate
152 inhalation port
30 heater assembly
32 top cap
40 heater
40*a* first part
40*b* second part
42 heating element
44 electrically insulating member
48 electrode
50 chamber
52 opening
54 non-holder
56 bottom
56*a* bottom wall
56*b* side wall
58 first guide
58*a* tapered surface
60 holder
62 pressing portion
62*a* inner surface
62*b* outer surface
66 non-pressing portion
66*a* inner surface
66*b* outer surface
67 gap
70 heat insulator
80 internal space

The invention claimed is:

1. An inhaler device comprising:

a heater configured to heat a substrate to generate an aerosol and measure temperature of the heater based on an electric resistance value of a heating resistor of the heater;

a controller configured to control an operation of the heater in accordance with a heating profile that defines a time-series progression of a target temperature, the target temperature being a target value of a temperature of the heater; and a temperature sensor configured to measure temperature of the heater, wherein the heating profile includes a plurality of time sections that are continuous along a time axis, each of the plurality of time sections is assigned the target temperature for an end of each time section, the heating profile includes an initial temperature rise section, an intermediate temperature drop section, and a temperature re-rise section in sequence, the target temperature set for the intermediate temperature drop section is lower than the target temperature set for the initial temperature rise section being a time section immediately before the intermediate temperature drop section, and the controller is configured to determine an end of the initial temperature rise section and the temperature re-rise section in accordance with temperature of the heater measured based on the electric resistance value, perform control such that no electric power is supplied to the heater in the intermediate temperature drop section, and determine an end of the intermediate temperature drop section in accordance with temperature of the heater measured by the temperature sensor.

2. The inhaler device according to claim 1, wherein the controller is configured to control the operation of the heater in accordance with an actual temperature of the heater and the target temperature set for the intermediate temperature drop section at a beginning of a time section subsequent to the intermediate temperature drop section.

3. The inhaler device according to claim 2, wherein the controller is configured to supply electric power to the heater at a first duty ratio at the beginning of the time section subsequent to the intermediate temperature drop section in a case where the actual temperature of the heater is less than the target temperature set for the intermediate temperature drop section, and supply electric power to the heater at a second duty ratio at the beginning of the time section subsequent to the intermediate temperature drop section in a case where the actual temperature of the heater is equal to or higher than the target temperature set for the intermediate temperature drop section, and the first duty ratio is larger than the second duty ratio.

4. The inhaler device according to claim 1, wherein the target temperature set for the initial temperature rise section is higher than an initial value.

5. The inhaler device according to claim 4, wherein the initial temperature rise section includes a first temperature rise section and a second temperature rise section subsequent to the first temperature rise section, the first temperature rise section and the second temperature rise section have different temperature rise widths per unit time, the temperature rise width per unit time in the first temperature rise section has a value obtained by dividing a difference between the target temperature set for the first temperature rise section and the initial value by a time length of the first temperature rise section, and the temperature rise width per unit time in the second temperature rise section has a value obtained by dividing a difference between the target temperature set for the second temperature rise section and the target temperature set for the first temperature rise section by a time length of the second temperature rise section.

6. The inhaler device according to claim 5, wherein the temperature rise width per unit time in the second temperature rise section is smaller than the temperature rise width per unit time in the first temperature rise section.

7. The inhaler device according to claim 4, wherein the initial temperature rise section includes a temperature maintenance section at an end thereof, and the target temperature set for the temperature maintenance section is the same as the target temperature set for a time section immediately before the temperature maintenance section.

8. The inhaler device according to claim 1, wherein the target temperature set for the temperature re-rise section is higher than the target temperature set for a time section immediately before the temperature re-rise section.

9. The inhaler device according to claim 8, wherein the temperature re-rise section alternately includes a temperature maintenance section and a temperature rise section, the target temperature set for the temperature maintenance section is the same as the target temperature set for a time section immediately before the temperature maintenance section, and the target temperature set for the temperature rise section is higher than the target temperature set for a time section immediately before the temperature rise section.

10. The inhaler device according to claim 1, wherein the heating profile further includes a temperature maintenance section, and the target temperature set for the temperature maintenance section is the same as the target temperature set for a time section immediately before the temperature maintenance section.

11. The inhaler device according to claim 1, wherein when compared among the initial temperature rise section, the intermediate temperature drop section, and the temperature re-rise section, an absolute value of an amount of change in the target temperature per unit time is smallest in the temperature re-rise section, second smallest in the intermediate temperature drop section, and largest in the initial temperature rise section, the absolute value of the amount of change in the target temperature per unit time in the initial temperature rise section is a value obtained by dividing an absolute value of a difference between the target temperature set for the initial temperature rise section and the initial value by a time length of the initial temperature rise section, the absolute value of the amount of change in the target temperature per unit time in the intermediate temperature drop section is a value obtained by dividing an absolute value of a difference between the target temperature set for the intermediate temperature drop section and the target temperature set for the time section immediately before the intermediate temperature drop section by a time length of the intermediate temperature drop section, and the absolute value of the amount of change in the target temperature per unit time in the temperature re-rise section is a value obtained by dividing an absolute value of a difference between the target temperature set for the temperature re-rise section and the target temperature set for the time section immediately before the temperature re-rise section by a time length of the temperature re-rise section.

12. The inhaler device according to claim 1, wherein when a time length of the initial temperature rise section, a time length of the intermediate temperature drop section, and a time length of the temperature re-rise section are compared, the time length of the intermediate temperature drop section is shortest, the time length of the initial temperature rise section is second shortest, and the time length of the temperature re-rise section is longest.

13. The inhaler device according to claim 1, further comprising a chamber configured to receive the substrate, wherein the chamber includes an opening into which the substrate is to be inserted, and a holder configured to hold the substrate, and the holder includes a pressing portion configured to press a portion of the substrate, and a non-pressing portion, and the heater is disposed on an outer surface of the pressing portion.

14. The inhaler device according to claim 1, wherein the temperature re-rise section includes a plurality of slots, the plurality of slots being time sections that are continuous along a time axis, and assigned the target temperature for an end of each of the plurality of slots, the target temperature set for a slot is equal to or higher than the target temperature set for another slot that is before the slot and that is continuous with the slot, each of the plurality of slots is assigned a plurality of switching conditions, and the controller is configured to switch a slot for which any one of the plurality of switching conditions is satisfied among the plurality of slots to another slot among the plurality of slots and control the operation of the heater in accordance with the another slot.

15. The inhaler device according to claim 1, wherein the controller is configured to control the operation of the heater in accordance with a deviation of an actual temperature of the heater from the target temperature corresponding to an elapsed time from a start of control of the operation of the heater based on the heating profile.

16. A control method for controlling an inhaler device including a heater configured to heat a substrate to generate an aerosol, the control method comprising:

measuring temperature of the heater based on an electric resistance value of a heating resistor of the heater;

controlling an operation of the heater in accordance with a heating profile that defines a time-series progression of a target temperature, the target temperature being a target value of a temperature of the heater; and measuring temperature of the heater using a temperature sensor, wherein the heating profile includes a plurality of time sections that are continuous along a time axis, each of the plurality of time sections is assigned the target temperature for an end of each time section, the heating profile includes an initial temperature rise section, an intermediate temperature drop section, and a temperature re-rise section in sequence, the target temperature set for the intermediate temperature drop section is lower than the target temperature set for the initial temperature rise section being a time section immediately before the intermediate temperature drop section, and the controlling of an operation of the heater includes determining an end of the initial temperature rise section and the temperature re-rise section in accordance with temperature of the heater measured based on the electric resistance value, performing control such that no electric power is supplied to the heater in the intermediate temperature drop section, and determining an end of the intermediate temperature drop section in accordance with temperature of the heater measured by the temperature sensor.

17. A non-transitory computer readable medium having a program stored therein, the program for causing a computer for controlling an inhaler device including a heater configured to heat a substrate to generate an aerosol, to execute:

measuring temperature of the heater based on an electric resistance value of a heating resistor of the heater;

controlling an operation of the heater in accordance with a heating profile that defines a time-series progression of a target temperature, the target temperature being a target value of a temperature of the heater; and measuring temperature of the heater using a temperature sensor, wherein the heating profile includes a plurality of time sections that are continuous along a time axis, each of the plurality of time sections is assigned the target temperature for an end of each time section, the heating profile includes an initial temperature rise section, an intermediate temperature drop section, and a temperature re-rise section in sequence, the target temperature set for the intermediate temperature drop section is lower than the target temperature set for the initial temperature rise section being a time section immediately before the intermediate temperature drop section, and the controlling of an operation of the heater includes determining an end of the initial temperature rise section and the temperature re-rise section in accordance with temperature of the heater measured based on the electric resistance value, performing control such that no electric power is supplied to the heater in the intermediate temperature drop section, and determining an end of the intermediate temperature drop section in accordance with temperature of the heater measured by the temperature sensor.

* * * * *